US006345169B1

(12) United States Patent
Haneda et al.

(10) Patent No.: US 6,345,169 B1
(45) Date of Patent: Feb. 5, 2002

(54) FIXING APPARATUS WITH HEAT RAY GENERATING DEVICE

(75) Inventors: Satoshi Haneda; Hiroyuki Tokimatsu; Masahiro Onodera, all of Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/607,167

(22) Filed: Jun. 29, 2000

(30) Foreign Application Priority Data

Jul. 1, 1999 (JP) ..... 11-187443
Jul. 12, 1999 (JP) ..... 11-197622

(51) Int. Cl.[7] ..... G03G 15/20

(52) U.S. Cl. ..... 399/328; 219/216; 399/67; 399/333

(58) Field of Search ..... 399/328, 330, 399/331, 333, 67, 69; 219/216, 243, 469; 118/60; 432/60

(56) References Cited

U.S. PATENT DOCUMENTS 3,948,214 A * 4/1976 Thettu ..... 118/60
5,689,788 A * 11/1997 Moser ..... 399/328
5,852,763 A * 12/1998 Okuda et al. ..... 399/331 X
6,085,059 A * 7/2000 Haneda et al. ..... 399/333
6,157,805 A * 12/2000 Haneda et al. ..... 399/328

FOREIGN PATENT DOCUMENTS

JP 52-106741 9/1977
JP 57-82240 5/1982
JP 57-102736 6/1982
JP 57-102741 6/1982
JP 59-65867 4/1984
JP 11-15322 * 1/1999

* cited by examiner

*Primary Examiner*—Sophia S. Chen
(74) *Attorney, Agent, or Firm*—Frishauf, Holtz, Goodman, Langer & Chick, P.C.

(57) ABSTRACT

A fixing apparatus for fixing a toner image on a transfer sheet with heat and pressure is provided with (A) a heating roller including a cylindrical light transmitting base member; a heat ray generating device, provided inside of the cylindrical light transmitting base member, to generate a heat ray; a heat ray transmitting elastic layer generate a heat ray; a heat ray transmitting elastic layer provided on an outer surface of the cylindrical light transmitting base member and including a rubber layer; and a heat ray absorbing layer, provided on the outer surface of the cylindrical light transmitting base member, to absorb the heat ray passing through both of the cylindrical light transmitting base member and the heat ray transmitting elastic layer, and (B) a pressing roller provided to come in contact with the heating roller so that the transfer sheet is nipped with a nip width between the heating roller and the pressing roller. The pressing roller includes a rubber layer and is linked with a driving device so that the pressing roller rotates the heating roller through the contact therewith.

24 Claims, 13 Drawing Sheets

FIG. 3
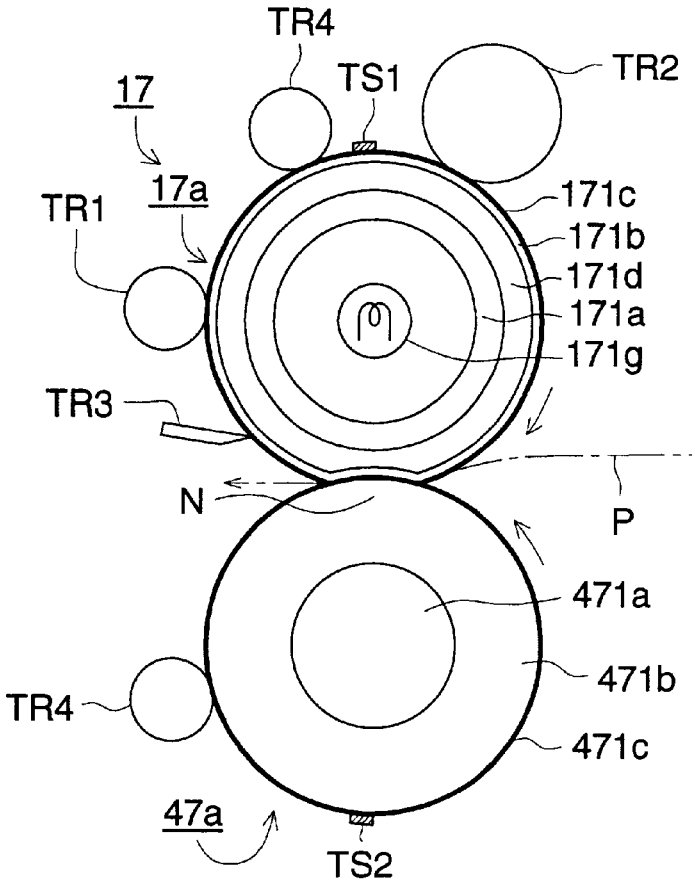
FIG. 4 (a)
FIG. 4 (b)
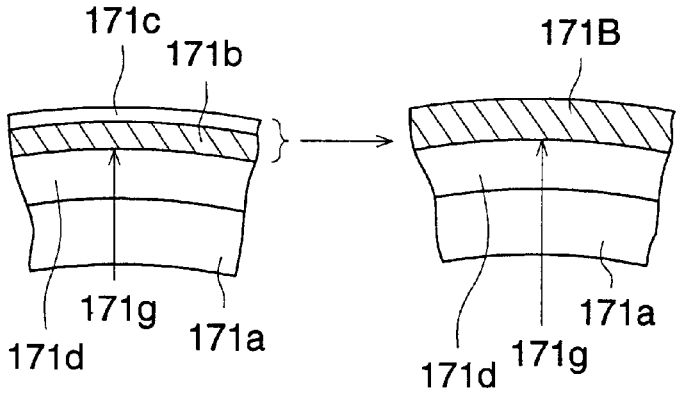

FIXING APPARATUS WITH HEAT RAY GENERATING DEVICE

BACKGROUND OF THE INVENTION

The present invention relates to a fixing apparatus for use in a copying machine, a printer and a facsimile machine, and in particular, to a fixing apparatus capable of conducting quick start fixing.

Heretofore, as a fixing unit used for a copying machine, a printer and a facsimile machine, those of a heat roller fixing system have been used widely for a low speed machine up to a high speed machine and for machines for monochromatic images and full-color images, as a stable and highly sophisticated one.

In the fixing unit of a conventional heat roller fixing system, however, when heating a transfer material and toner, there has been a problem that it is disadvantageous for energy conservation because of poor effect of energy conservation because a fixing roller with great heat capacity needs to be heated, and a long time is required for warming a fixing unit in the course of printing, resulting in a long printing time (warming-up time).

A fixing unit of a film fixing system wherein a film (heat fixing film) is used to solve the above-mentioned problem, a heat roller is changed to a heat fixing film having an ultimate thickness and low heat capacity, heat conduction efficiency is extremely improved by bringing the temperature-controlled heater (ceramic heater) into direct contact with the heat fixing film, and thereby, energy conservation and quick start which hardly requires warming-up time are achieved, and a color image forming apparatus employing the fixing unit of a film fixing system, have been proposed, and they are used recently.

Fixing methods wherein a light transmissive base member representing a variation of the heat roller is used as a heat ray fixing roller (a roller member for heat ray fixing), and heat ray emitted from a halogen lamp (heat ray irradiating means) provided inside is projected on toner to heat and fix the toner and quick start requiring no warming-up time is achieved, are disclosed in TOKKAISHO Nos. 52-106741, 57-82240, 57-102736 and 57-102741. Further, a fixing method wherein a heat ray fixing roller (a roller member for heat ray fixing) is constructed by providing a light absorbing layer on an outer periphery of a light transmissive base member, heat ray emitted from a halogen lamp (heat ray irradiating means) provided inside of the light transmissive base member is absorbed by the light absorbing layer provided on the outer periphery of the light transmissive base member and a toner image is fixed by heat of the light absorbing layer, is disclosed in TOKKAISHO Nos. 59-65867.

However, in the method disclosed in TAKKAISHO No. 52-106741 wherein toner is irradiated by a heat ray emitted from a halogen lamp (heat ray irradiation means) is applied to toner through a light transmissive base member to heat and fix the toner, and in the method disclosed in TAKKAISHO No. 59-65867 wherein a heat ray fixing roller (heat ray fixing roller member) is structured by providing a light absorbing layer (heat ray absorbing layer) on an outer circumferential surface of a light transmissive base member, and a heat ray emitted from a halogen lamp (heat ray irradiation means) is applied to the light absorbing layer through the light transmissive base member so that toner may be fixed by heat of the light absorbing layer, there are achieved both energy conservation and quick start with decreased warming-up time. However, in the heat ray fixing roller member, a cylindrical glass member is mainly used as a material of the light transmissive base member in the heat ray fixing roller member. Therefore, when a flange member into which a bearing member (bearing) is to be fitted is forced in the heat ray fixing roller member for trying to drive it, the light transmissive base member tends to crack, and it is difficult to drive the heat ray fixing roller member. A primary portion of the first object of the invention is to solve the problem mentioned above and to make the heat ray fixing roller member to rotate without being subjected to damage of its light transmissive base member employing a glass member. In addition to the foregoing, another portion of the first object is to obtain conditions and structure of the roller for improving fixing capacity in the nip portion formed between the heat ray fixing roller member and a pressure rubber roller provided to face the heat ray fixing roller member.

Further, when a heat ray fixing roller of a fixing unit is being energized and in the initial stage of temperature rise of the heat ray fixing roller, heat on the surface of the heat ray fixing roller flows out to the light transmissive base member to be used to heat it. Therefore, if a pressure rubber roller provided to face the heat ray fixing roller is kept to be in contact with the heat ray fixing roller to rotate further, heat flows out to the pressure rubber roller, delaying temperature rise of the heat ray fixing roller, which is a problem. When the pressure rubber roller is warmed sufficiently, on the other hand, a temperature of the heat ray fixing roller can be raised quickly when it is energized. However, when the heat ray fixing roller is kept to be energized as the condition that the pressure rubber roller is not rotating when energizing of the heat ray fixing roller is suspended, the pressure rubber roller and the heat ray fixing roller are deteriorated, or deformed by temperature rise, which is a problem. In particular, temperature rise on a boundary surface between a heat ray absorbing layer of the heat ray fixing roller and a light transmissive elastic layer that is on the inside of the heat ray absorbing layer is so remarkable that the heat ray absorbing layer comes off the light transmissive elastic layer, which is also a problem.

The second object of the invention is to solve the problems stated above and thereby to provide a fixing unit wherein an outflow of heat from an energized heat ray fixing roller member to a pressure rubber roller is prevented, speedup for temperature rise of the heat ray fixing roller member is achieved, deterioration of the heat ray fixing roller member and the pressure rubber roller caused by contact between them is prevented, and exfoliation between the heat ray absorbing layer and the light transmissive elastic layer on their boundary surface is prevented.

SUMMARY OF THE INVENTION

The first object stated above can be attained by the following structures.

Structure (1)

A fixing unit for fixing a toner image formed on a transfer material on the transfer material under heat and pressure, wherein there is formed a roll-shaped heat ray fixing rotating member which has therein a heat ray emitting means that emits heat rays, and is provided with a cylindrical light transmissive base member that transmits heat rays, a light transmissive elastic layer composed of a light transmissive rubber layer on the outer side of the light transmissive base member, and a heat ray absorbing layer that is arranged on the outer side of the light transmissive elastic layer and absorbs heat rays, and a pressure rubber roller is provided to face the heat ray fixing roller member.

Structure (2)

The fixing unit according to Structure (1), wherein a rubber hardness of the pressure rubber roller is higher than that of the heat ray fixing roller member.

Structure (3)

The fixing unit according to Structure (1), wherein the pressure rubber roller is in a form of an inversed crown.

Structure (4)

The fixing unit according to Structure (1), wherein the fixing unit can move in the direction of an arc of the driving gear around the center of the driving gear for the pressure rubber roller.

Structure (5)

The fixing unit according to Structure (1), wherein a rubber hardness of the pressure rubber roller is 80° or less.

Structure (6)

The fixing unit according to Structure (1), wherein an outside diameter of the pressure rubber roller is 60 mm or less, and a width of a nip formed by the pressure rubber roller and the heat ray fixing roller member is 10 mm or less.

Structure (7)

The fixing unit according to Structure (1), wherein an outside diameter of the pressure rubber roller is 60 mm or less, and a thickness of a rubber roller of the pressure rubber roller is 2 mm or more Structure (8)

The fixing unit according to Structure (1), wherein the relationship of $\phi 1<\phi 2$ is satisfied when $\phi 1$ represents an outside diameter of the heat ray fixing roller member and $\phi 2$ represents an outside diameter of the pressure rubber roller.

The second object stated above can be attained by the following structures.

Structure (9)

A fixing unit for fixing a toner image formed on a transfer material on the transfer material under heat and pressure, wherein there is formed a roll-shaped heat ray fixing rotating member which has therein a heat ray emitting means that emits heat rays, and is provided with a cylindrical light transmissive base member that transmits heat rays, a light transmissive elastic layer located on the outer side of the light transmissive base member, and a heat ray absorbing layer that is arranged on the outer side of the light transmissive elastic layer and absorbs heat rays, and a pressure rubber roller is provided to face the heat ray fixing roller member, and when the heat ray fixing roller member is energized, rotation of the heat ray fixing roller member caused by contact with the pressure rubber roller is started when a temperature of the heat ray fixing roller member is raised up to the prescribed temperature or higher.

Structure (10)

The fixing unit according to Structure (9), wherein rotation of the heat ray fixing roller member is stopped after stop electricity for the heat ray fixing roller member is stopped.

BRIEF DESCRIPTION OF THE DRAWINGS

FIG. 3 is an explanatory view showing a construction of a fixing apparatus.

FIGS. 4(*a*) and 4(*b*) are enlarged section structural views a roll-shaped roller member for heat ray fixing in FIG. 3.

DETAILED DESCRIPTION OF THE PREFERRED EMBODIMENT

Hereinafter, an embodiment of the present invention will be explained. Incidentally, the following description is not intended to limit the technical scope of claims and meaning of technical terms. Also, the following explanation in the embodiment of the invention shows a best mode and does not limit the technical scope and the meaning of technical terms.

Figure 1:
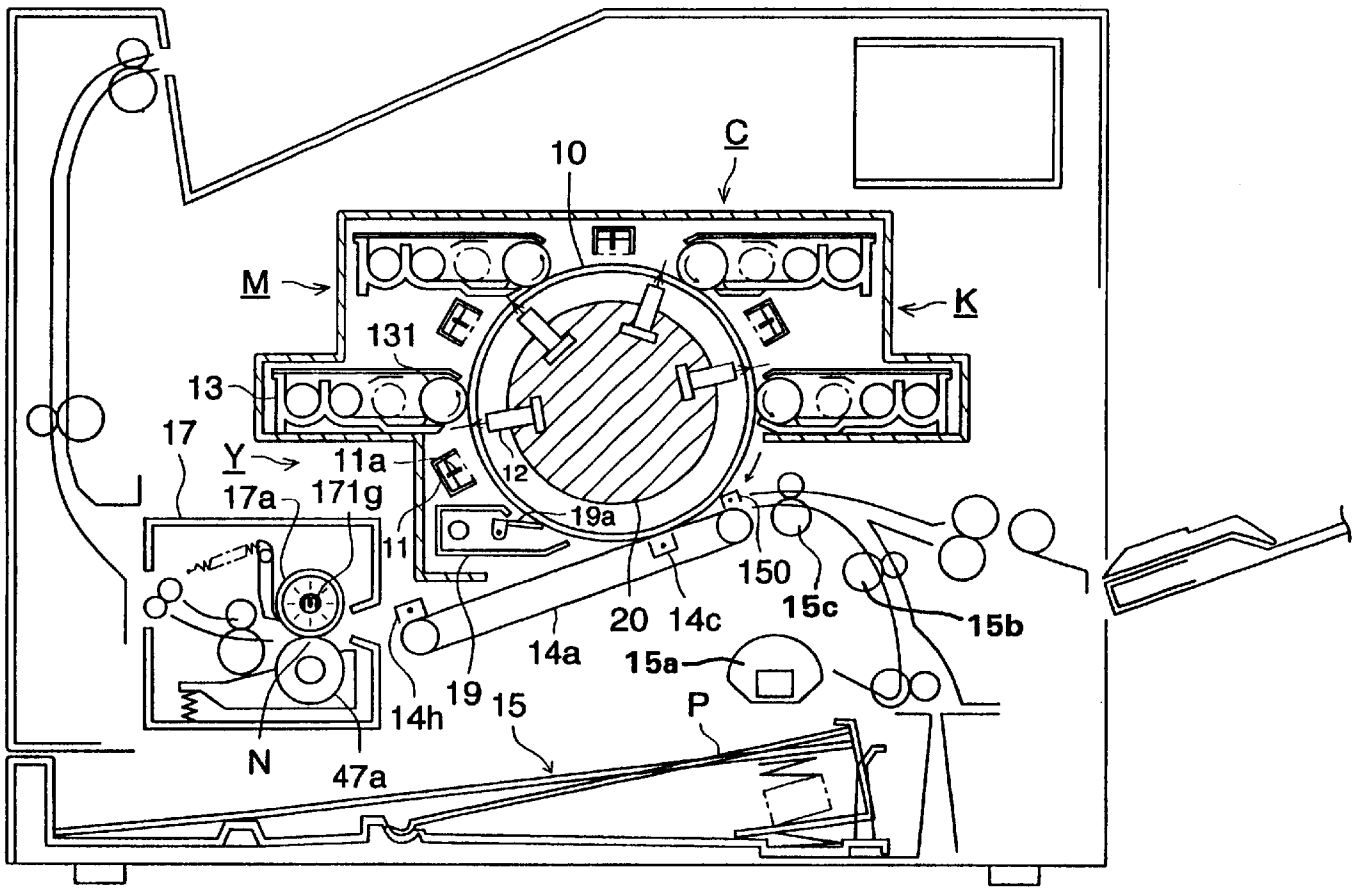
FIG. 1 is a sectional structure diagram of a color image forming apparatus showing an embodiment of an image forming apparatus employing the fixing unit related to the invention.
Figure 5:
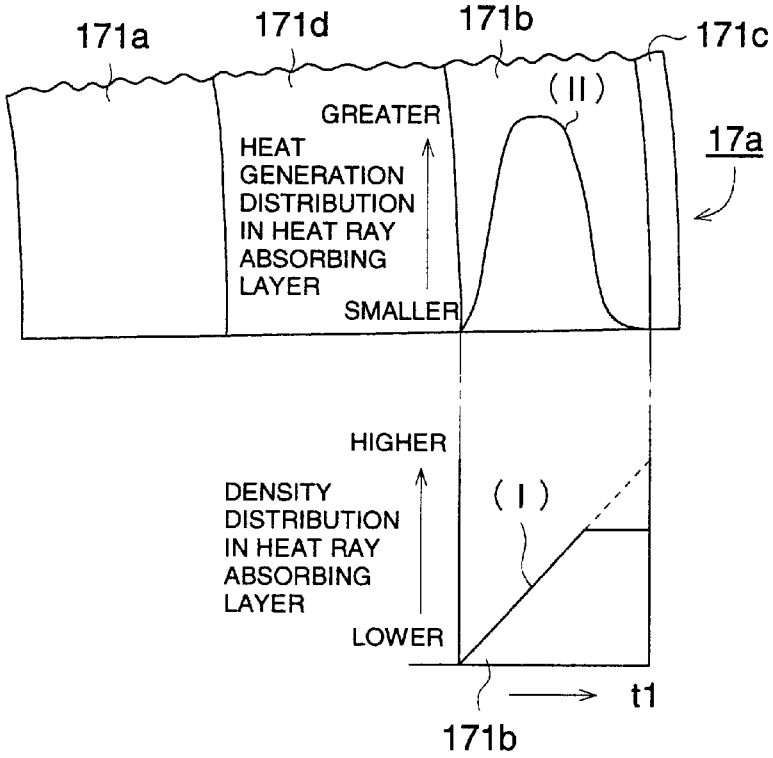
FIG. 5 is a diagram showing density distribution in a heat ray absorbing layer of a roll-shaped roller member for heat ray fixing in FIG. 3.
Figure 6:
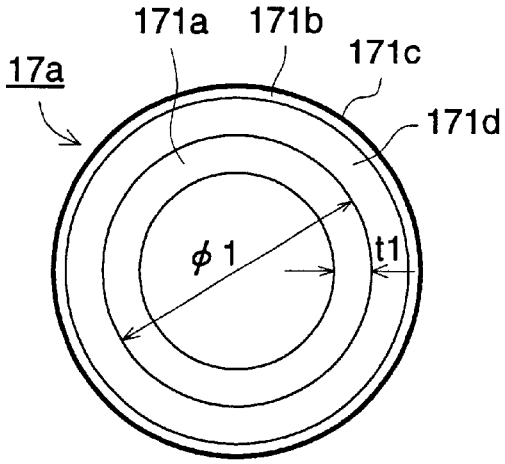
FIG. 6 is a diagram showing an outside diameter and a thickness of a light transmissive base member of a roll-shaped roller member for heat ray fixing in FIG. 3.

An image forming process and each mechanism in an embodiment of an image forming apparatus employing a fixing apparatus of the present invention is explained with reference to FIGS. 1 through 6. FIG. 1 is a sectional structure diagram of a color image forming apparatus showing an embodiment of an image forming apparatus employing the fixing unit related to the invention, FIG. 2 is a side cross sectional view of the image forming member, FIG. 3 is an explanatory view showing a construction of a fixing apparatus, FIGS. 4(*a*) and 4(*b*) are enlarged section structural views a roll-shaped roller member for heat ray fixing in FIG. 3, FIG. 5 is a diagram showing density distribution in a heat ray absorbing layer of a roll-shaped roller member for heat ray fixing in FIG. 3, and FIG. 6 is a diagram showing an outside diameter and a thickness of a light transmissive base member of a roll-shaped roller member for heat ray fixing in FIG. 3.

Figure 2:
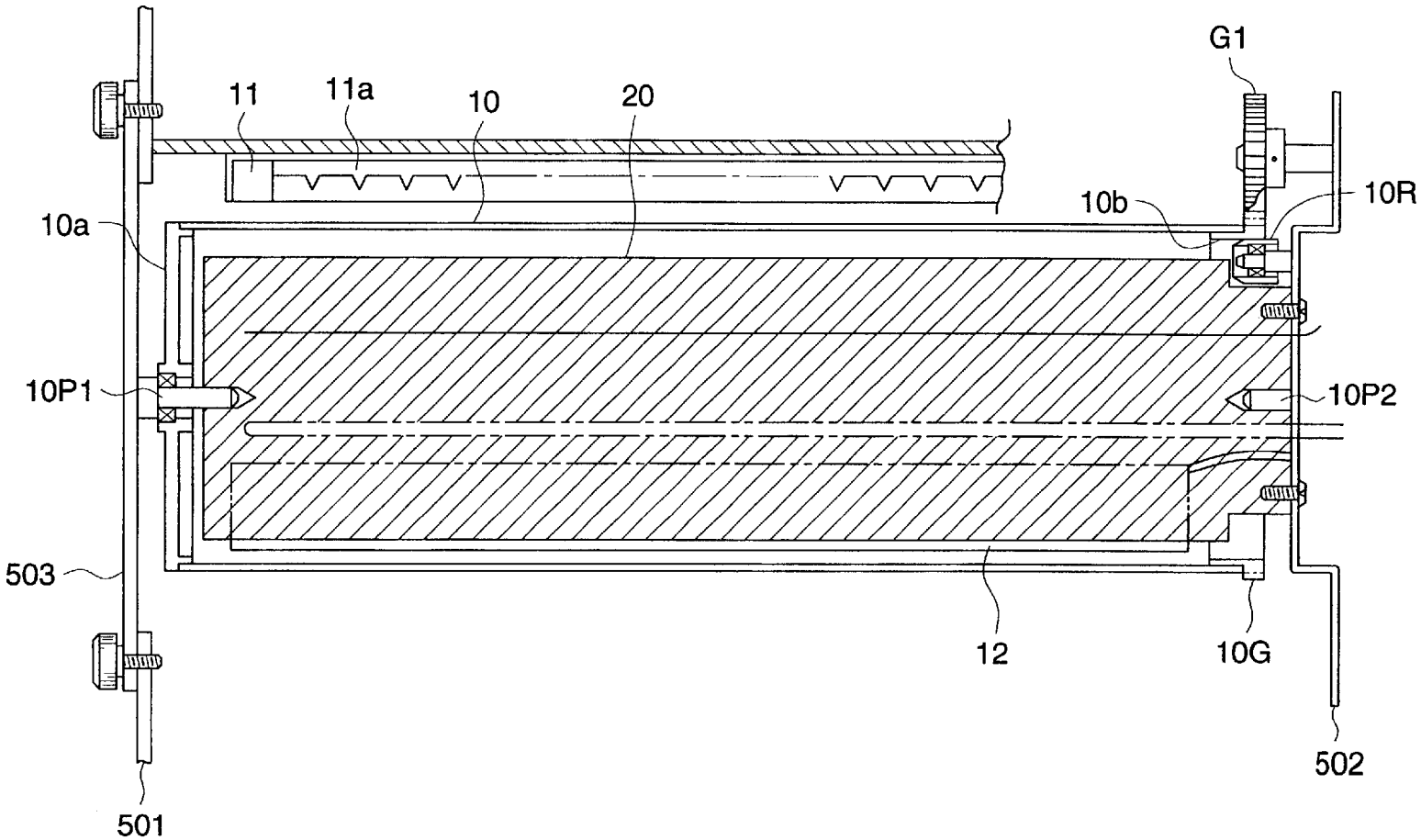
FIG. 2 is a side cross sectional view of the image forming member.

According to FIG. 1 or FIG. 2, a photoreceptor drum 10 is an image carrier in which a photoconductive layer of a a transparent conductive layer and an organic photoreceptor layer (OPC) is formed on an outer periphery of a cylindrical base body formed by a transparent member of, for example, glass or transparent acrylic resin.

The photoreceptor drum 10 is rotated in the clockwise direction indicated with arrow mark in FIG. 1 by driving power from a driving source not shown in the drawing on the condition that its light transmissive layer is granded.

The photoreceptor drum 10 is mounted between a front flange 10*a* and a rear flange 10*b;* the front flange 10*a* is pivoted by a guide pin 10P1 provided on a cover 503, attached to a front side plate 501 of the apparatus main body; the rear flange 10*b* is engaged on the outer surface of a plurality of guide rollers 10R, provided on a rear side plate 502 of the apparatus main body; and thereby the photoreceptor drum 10 is held. A gear 10G, provided on the outer periphery of the rear flange 10*b,* is engaged with a driving gear G1, and by its driving power, the photoreceptor drum 10 is rotated clockwise as shown in FIG. 1, while the transparent conductive layer is electrically grounded.

In the present invention, an exposure beam for imagewise exposure may have only an amount of exposure of a wavelength which can provide an appropriate contrast on a light conductive layer of the photoreceptor drum which is a image forming point. Accordingly, it is not necessary that the light transparency factor of a transparent base body of the photoreceptor drum be 100%, but may have a characteristic in which some amount of light is absorbed at the time of transmission of the exposure beam. A essential point is to provide an appropriate contrast. As light transmissive base body materials, acrylic resins, specifically, polymers incorporating a methyl methacrylate monomer, are excellent for the transparency, strength, accuracy, surface property, etc., and are preferably used. Further, any type of light transmissive resins such as acryl, fluorine, polyester, polycarbonate, polyethylene terephthalate, etc., which are used for general optical members, may be used. The material may even be colored if it still has light permeability with respect to the exposure light beams. As a light conductive layer, indium, tin oxide (ITO), lead oxide, indium oxide, copper iodide, or a metallic film, in which light permeability is still maintained, and which is formed of Au, Ag, Ni, Al, etc., can be used. As film forming methods, a vacuum deposition method, an activated reaction deposition method, any type of spattering method, any type of CVD method, any dip coating method, any spray coating method, etc., can be used. As light conductive layers, any type of organic photoreceptor layer (OPC) can be used.

An organic light sensitive layer of as the light sensitive layer of the photoconductive layer is made in a two layer construction in which a function is separated into a charge generating layer (CGL) whose main component is a charge generating material (CGM) and a charge transporting layer (CTL) whose main component i s a charge transporting material (CTM). Since CTL in the two layer construction of the organic light sensitive layer is thicker, the durability as the organic light sensitive layer is high. Therefore, the two layer construction of the organic light sensitive layer is suitable to the present invention. Incidentally, the organic light sensitive layer may be made in a single layer construction in which a charge generating material (CGM) and a charge transporting material (CTM) are contained in the single layer. The two layer construction and the single layer construction usually contain a binder resine.

A scorotron charger 11 as a charging means, an exposure optical system 12 as image writing means and a developing device 13 as a developing means are prepared for image forming processes of each color of yellow (Y), magenta (M), cyan (C) and black (K). In the present embodiment, these devices are arranged in the order of Y, M, C and K in terms of the rotation direction of the photoreceptor drum 10 indicated with an arrow mark in FIG. 1.

A scorotron charger 11, which is a charging means, is mounted in the direction perpendicular to the moving direction of the photoreceptor drum 10 (the direction perpendicular to the surface of the sheet of FIG. 1) and opposed to the photoreceptor drum 10 which is an image carrier; and it charges (negative charging in the present example) the organic photoreceptor layer on the photoreceptor drum 10 by a corona discharge with the same polarity as the toner, by using a control grid (not provided with a sign) having a predetermined potential voltage and, for example, a saw tooth type electrode as a discharge electrode 11*a,* so that a uniform potential voltage is applied onto the photoreceptor drum 10. As the discharge electrode 11*a,* a wire electrode can also be used instead of the above cited electrode.

An exposure optical system 12 is structured as a unit for the exposure, onto which a linear exposure element in which a plurality of LEDs (light emitting diodes) as a light emitting element for image exposure lights are arrayed, and a Selfoc lens as an equal-sized image forming element, are attached onto a holder (not shown), wherein the LEDs and the Selfoc lens are arranged in the primary scanning direction parallel to the axis of the photoreceptor drum 10. The exposure unit 12 for each color is attached onto a cylindrical holding member 20 which is fixed by being guided by a guide pin 10P2, provided on a rear side plate 502 of the apparatus main body, and another guide pin 10P1, provided on a cover 503 attached on a front side plate 501, and is accommodated inside the base body of the photoreceptor drum 10. As the exposure elements, a linear exposure element in which a plurality of light emitting elements such as Fls (fluorescent material emission elements), Els (electro-luminescence elements), PLs (plasma discharge elements), LEDs (light emitting diodes), etc., are aligned array-like, is used other than the above-described elements.

The exposure optical system 12 representing an image writing means for each color is arranged in the photoreceptor drum 10 in a manner that the exposure position on the photoreceptor drum 10 is between the scorotron charging device 11 and the developing device 13 and at the upstream side of the aforesaid developing device 13 in the rotation direction of the photoreceptor drum 10.

The exposure optical system 12 conducts imagewise exposure onto the uniformly-charged photoreceptor 10 after conducting image processing based on image data of each color which are sent from a separately-constructed computer (not depicted in the drawing and are stored in a memory and forms a latent image on the photoreceptor drum 10. The wavelength of light emission of the light emitting elements used in the present invention is preferable in the range of 680–900 nm, in which the permeability of Y, M, C toners is normally high. However, because image exposure is carried out from the rear surface of the photoreceptor drum, the shorter wavelength, which has insufficient transparency for color toner, may be used.

The developing devices 13, which are developing means for each color, respectively accommodate one-component or two-component developers for yellow (Y), magenta (M), cyan (C) and black (K), and are provided with developing sleeves 131, formed of, for example, cylindrical non-magnetic stainless steel or aluminium material of 0.5–1 mm thickness, and of 15–25 mm outer diameter, developing sleeves.

In the developing region, the developing sleeve 131 is maintained to be in non-contact with the photoreceptor drum 10 by a spacing roller, not shown, while keeping a predetermined gap, for example, of 100–1000 $\mu$m. The developing sleeve 131 rotates in the following direction with the rotating direction of the photoreceptor drum 10 at the closest position. A DC voltage having the same polarity as that of toner (minus polarity in this embodiment), or a voltage on which an AC voltage AC is superimposed in addition to the DC voltage, is applied as a developing bias voltage on the developing sleeve 131 and jumping reversal development is carried out on the exposed portions on the photoreceptor drum 10. At this time, an accuracy of the developing gap is needed to be 20 $\mu$m or less in order to avoid image irregularities.

As stated above, the developing device 13 conducts the reversal development for an electrostatic latent image on the photoreceptor drum 10, which is formed by charge of the scorotron charger 11 and image exposure by the exposure unit 12, in a no-contact condition, by the non-contact development method by application of a development bias voltage, by using toner having the same polarity as the charged polarity (in the present example, the photoreceptor drum is negatively charged, and the polarity of toner is also negative).

A photoreceptor driving motor, not shown, is started at the start of image formation; a gear 10G provided on a rear flange 10*b* of the photoreceptor drum 10 is rotated through a driving gear G1; the photoreceptor drum 10 is rotated clockwise as shown by the arrow in FIG. 1; and simultaneously, application of potential voltage is started on the photoreceptor drum 10 by the charging operation of the Y scorotron charger 11. After application of the potential voltage on the photoreceptor drum 10, exposure by electrical signals corresponding to the first color signal, that is, Y image data, is started by the Y exposure optical system 12, and an electrostatic latent image is formed on the photoreceptor layer of the photoreceptor drum 10 corresponding to the Y image of the document image by rotational scanning of the drum. This latent image is reversal-developed by the Y developing device 13 under non-contact condition of developer on the developing sleeve, and a yellow (Y) toner image is formed on the photoreceptor drum 10 corresponding to its rotation.

Next, potential voltage is applied on the yellow (Y) toner image formed on the photoreceptor drum 10, by the charging operation of the scorotron charger 11 for magenta (M); exposure is carried out by electrical signals corresponding to the second color signal of the exposure unit 12, that is, image data of M; and then, the magenta (M) toner image is formed by successively being superimposed on the yellow (Y) toner image by the non-contact reversal development by the developing device 13 for M.

Further, in the same process, the cyan (C) toner image corresponding to the third color signal is formed by the scorotron charger 11 for cyan (C), the exposure unit 12 for C, and the developing device 13 for C; and the black (K) toner image corresponding to the fourth color signal is successively formed by being superimposed on other toner images by the scorotron charger 11 for black (K), the exposure unit 12 and developing device 13 for (K); and a full color toner image is formed on the peripheral surface of the photoreceptor drum 10 during a single rotation.

In this manner, in the present embodiment, the exposure onto the organic photoreceptor layer of the photoreceptor drum 10 by the exposure units 12 for Y, M, C and K is carried out from the inside of the drum through the transparent base body. Accordingly, the exposure for the image corresponding to the second, third and forth color signals is carried out without light shielding by the previously formed toner images, so that the electrostatic latent image similar to the image corresponding to the first color signal can be formed. However, the exposure can be conducted from the outside of the photoreceptor drum 10.

On the other hand, a recording sheet P, which is a transfer material, is sent from a sheet feed cassette 15, which is a transfer material accommodation means, by a feed roller 15*a,* and fed and conveyed to a timing roller 15*c* by a sheet feed roller 15*b*.

The recording sheet P is charged so as to be attracted to the conveyor belt 14*a* by a paper charging device 150 as the paper charging means and is sent to the transfer area by the timing roller 15*c* in synchronization with the color toner image which is carried on the photoreceptor drum 10. The recording sheet P is conveyed on the close contact condition by the conveyance belt 14*a* and the color toner images carried on the peripheral surface of the photoreceptor drum 10 are collectively transferred onto the upper surface side of the recording sheet P by the transfer device 14*c* which applies voltage with the reversed polarity to the toner (in the present example, positive polarity)

The recording sheet P onto which the color toner image has been transferred, is discharged by a sheet separation AC discharger 14*h* as the transfer material separating means, separated from the conveyance belt 14*a,* and is conveyed to a fixing device 17.

Toner remaining on the circumferential surface of the photoreceptor drum 10 after transfer is cleaned with a cleaning blade 19*a* provided on a cleaning device 19 as an image forming member cleaning means. The photoreceptor drum 10 is subject to an uniform charging by the scorotron charging device 11 after the residual tone is removed, and then is brought into a next image forming cycle.

As is shown in FIG. 3, a fixing unit 17 is composed of heat ray fixing roller 17*a* as an elastic roll-shaped roller member (upper side fixing member) for heat ray fixing on the upper side for fixing toner images on a transfer material and pressing rubber roller 47*a* as an elastic lower side fixing member, and a nipping section N is formed between the heat ray fixing roller 17*a* having a high elasticity and the pressing rubber roller 47*a* having an elasticity. A recording sheet P is nipped at the nipping section N having a width of 15 mm or less, preferably 5 mm or more, and then applied with heat and pressure to fix toner images on the recording sheet P. The recording sheet P as a transfer sheet proceeds so as to hit the heat ray fixing roller 17*a* with its tip section and passes over the nipping section N. On the heat ray fixing roller 17*a,* there are provided, from a position of the nipping section N in the rotary direction of the heat ray fixing roller 17*a,* fixing separation claw TR3, fixing oil cleaning roller TR1, heat equalizing roller TR4, and oil coating roller TR2. Oil is supplied to the heat ray fixing roller 17*a* by the oil coating roller TR2 in which a felt member containing oil is wound around a cylindrical aluminum pipe or a paper tube. The fixing oil cleaning roller TR1 cleans oil on the circumferential surface of the heat ray fixing roller 17*a.* Therefore, the heat equalizing roller TR4 and a temperature sensor TS1 which is a temperature detecting means to measure temperature of the heat ray fixing roller 17*a* and will be explained later, are provided on the cleaned circumferential surface of the heat ray fixing roller 17*a* between the fixing oil cleaning roller TR1 and the oil coating roller TR2. The transfer material after fixing is separated by the fixing separation claw TR3. Further, the heat generation temperature distribution on the circumferential surface on the heat ray fixing roller 17*a* heated by the heat ray absorbing layer 171*b* is equalized by the heat equalizing roller TR4 employing a metallic roller having a good thermal conductivity such as aluminum material and stainless material or a heat pipe. Temperature irregularities in the longitudinal direction and the transverse direction on the heat ray fixing roller 17*a* caused by the passing transfer sheet is equalized by the equalizing roller TR4.

The heat ray fixing roller 17*a* is structured as a soft roller wherein cylindrical light-transmissive base body 171*a* is provided, on its outside (outer circumferential surface), provided with light transmissive elastic layer 171*d,* heat ray absorbing layer 171*b* and releasing layer 171*c* in this order. Inside the light-transmissive base body 171*a,* there is provided a halogen lamp 171*g* or a xenon lamp (not illustrated) as the heat ray irradiating member emitting heat rays such as infrared rays containing visual rays depending on a light source or far infrared rays. Heat rays emitted from the halogen lamp 171*g* or the xenon lamp (not illustrated) are absorbed by the heat ray absorbing layer 171*b,* whereby a roll-shaped heat ray fixing rotating member capable of heating rapidly is formed.

In the pressing rubber roller 47*a* as the lower side fixing member, a roller member is formed by a core metal 471*a* made of aluminum material and a rubber roller layer 471*b* provided on the core metal, wherein the rubber roller layer is made of, for example, a silicone rubber and has a thickness of 2 mm to 10 mm and a rubber hardness higher than that of the light transmissive elastic layer 171*d* of the heat ray fixing roller 17*a* as mentioned later. The pressing rubber roller 47*a* is constructed as a soft roller having an elasticity in which an outside (an outer circumferential surface) of a rubber layer 471*b* of the roller member is covered with a fluorine resin tube 471*c* having a heat resistance such as PFA and PTF having a releasing property. Further, a heat equalizing roller TR4 is provided so as to come in contact with the surface of the rubber roller layer 471*b.* The heat equalizing roller TR4 rotates, following the rotation of the pressing rubber roller 47*a.* The heat equalizing roller TR4 employs a metallic roller member having a good thermal conductivity such as aluminum material and stainless material. The heat generation temperature distribution on the circumferential surface of the pressing rubber roller 47*a* is equalized by the heat equalizing roller TR4. As the heat equalizing roller TR4, it may be preferable to use a heat pipe capable of functioning both of heat accumulation and heat dispersion.

Between the soft roller having a high elasticity on the upper side and the soft roller having an elasticity on the lower side, there is formed nipping section N whose upper side is convex where toner images are fixed.

The symbol TS1 is a temperature sensor as a temperature detecting means employing, for example, a contact type thermister which is mounted on the upper heat ray fixing roller 17*a* and conducts temperature control, while TS2 is a temperature sensor employing, for example, a contact type thermister which is mounted on the lower pressing rubber roller 47*a* and conducts temperature control. As the temperature sensors TS1 and TS2, besides the contact type thermister, it may also possible to use a non-contact type.

In the structure of the heat ray fixing roller 17*a* in FIG. 4(*a*), ceramic materials having a thickness of 1 to 20 mm, preferably 2 to 5 mm, such as Pyrex glass, sapphire ($Al_2O_3$), and $CaF_2$ (thermal conductivity: (5 to 20)×$10^{-3}$ J/cm·s·K, a specific heat: (0.5 to 2.0)×J/g·K, a specific gravity: (1.5 to 3.0)) is mainly used as a cylindrical light transmissive base member 171*a* which transmits heat ray such as infrared rays or far infrared rays emitted from the halogen lamp 171*g* or the xenon lamp (not illustrated). Besides, it may be possible to use light-transmissive resin (thermal conductivity: (2 to 4)×$10^{-3}$ J/cm·s·K, specific heat: (1.0 to 2.0)×J/g·K, a specific gravity: (0.8 to 1.2)) employing polyimide or polyamide. For example, when Pyrex glass (specific heat: 0.78 J/g·K, specific gravity: 2.32) having an inside diameter of 32 mm, an outside diameter of 40 mm, a layer thickness (thickness) of 4 mm is used as the light transmissive base member 171*a* of the heat ray fixing roller 17*a,* a heat capacity Q1 of the light transmissive base member 171*a* for a A-3 size width (297 mm) is about 60 cal/deg.

Since a wavelength of a heat ray transmitted through the light transmissive base member 171*a* is 0.1–20 $\mu$m, and preferably is 0.3–3 $\mu$m, the light-transmissive base body 171*a* may also be formed with a resin binder into which fine particles of a metal oxide such as ITO, titanium oxide, aluminum oxide, zinc oxide, silicon oxide, magnesium oxide, or calcium carbonate having heat ray transmissivity (transmissivity for infrared ray or far infrared ray containing visual light depending on the light source) of average particle size of not more than 1 $\mu$m, preferably of not more than 0.1 $\mu$m including primary and secondary particles having a particle size of not more than ½, preferably ⅕ of a wavelength of heat ray are dispersed as adjusting agents for hardness and thermal conductivity. It is preferable to prevent light dispersion and to make light to reach the heat ray absorbing layer 171*b* that an average particle size including primary and secondary particles is not more than 1 $\mu$m, and preferably is not more than 0.1 $\mu$m. As stated above, thermal conductivity of the light transmissive base member 171*a* is not so high.

The light transmissive elastic layer 171*d* is formed with a heat-ray-transmissive rubber layer (base layer) which transmits aforesaid heat ray (infrared ray or far infrared ray containing visual light depending on the light source), by using, for example, silicone rubber having a thickness of 0.5 mm to 10 mm, more preferably a thickness of 2 mm–5 mm. For the light transmissive elastic layer 171*d,* there is taken a method to improve thermal conductivity by combining powder of metal oxide such as silica, aluminum and magnesium oxide with base rubber (silicone rubber) as a filler, for coping with the high speed, and a rubber layer having thermal conductivity: (1 to 3)×$10^{-3}$ J/cm·s·K, specific heat: (1 to 2)×J/g·K, specific gravity: 0.9 to 1.0) is used. For example, when silicone rubber (specific heat: 1.1 J/g·K, specific gravity: 0.91) having an outside diameter of 50 mm, a layer thickness (thickness) of 5 mm is used as the light transmissive elastic layer 171*d* of the heat ray fixing roller

17*a,* a heat capacity Q2 of the light transmissive elastic layer 171*d* for a A-3 size width (297 mm) is about 50 cal/deg. Since the heat conductivity of the rubber layer is lower by one place of figure than the light transmissive base member (heat conductivity: (5 to 20)×$10^{-3}$ J/cm·s·K) employing a glass member, it acts as a layer having a heat insulating ability. When thermal conductivity is raised, rubber hardness tends to be higher in general, including an example that hardness which is normally 40 Hs is raised nearly to 60 Hs (JIS, A rubber hardness). Preferably, the rubber hardness is 5 Hs to 60 Hs (JIS, A rubber hardness). The greater part of the elastic layer 171*d* of a roller member for heat ray fixing is occupied by this base layer, and an amount of compression in pressurizing is determined by rubber hardness of a base layer. On an intermediate layer of the elastic layer 171*d,* there is coated fluorine rubber to thickness of 20–300 μm as an oil-resisting layer for the purpose of preventing oil swelling. As silicone rubber for the top layer of the elastic layer 171*d,* RTV (room temperature vulcanizing) or LTV (low temperature vulcanizing) which is better in terms of releasing property than HTV (high temperature vulcanizing) is covered with a thickness similar to that of the intermediate layer. Since a wavelength of a heat ray transmitted through the elastic layer 171*d* is 0.1–20 μm, and preferably is 0.3–3 μm, the elastic layer 171*d* may also be formed with those wherein fine particles of a metal oxide such as titanium oxide, aluminum oxide, zinc oxide, silicon oxide, magnesium oxide, or calcium carbonate having heat ray transmissivity (mainly infrared ray transmissivity or far infrared ray transmissivity) of average particle size of not more than 1 μm, preferably of not more than 0.1 μm including primary and secondary particles having a particle size of not more than ½ preferably not more than ⅕ of a wavelength of heat ray are dispersed, as adjusting agents for hardness and thermal conductivity, in resin binders. It is preferable to prevent light dispersion and to make light to reach the heat ray absorbing layer 171*b* that an average particle size including primary and secondary particles is not more than 1 μm, and preferably is not more than 0.1 μm. Owing to the elastic layer 171*d* thus provided, heat ray fixing roller 17*a* representing a roller member for heat ray fixing can be structured as a soft roller having high elasticity.

With regard to heat ray absorbing layer 171*b,* heat ray absorbing member in which powder of carbon black, graphite, black iron oxide ($Fe_3O_4$), various ferrite and their compounds, oxidized copper, cobalt oxide and Indian red ($Fe_2O_3$) are mixed with resin binders is used, and the heat ray absorbing member stated above having a thickness of 10–500 μm, preferably of 20–100 μm is formed on the outside (outer circumferential surface) of the light transmissive elastic layer 171*d* through blasting or coating so that heat ray remaining after heat ray emitted from the halogen lamp 171*g* or the xenon lamp (not illustrated) have absorbed by the light transmissive base member 171*a* and the light transmissive elastic layer 171*d,* corresponding in amount to heat ray of 90–100%, preferably of 95–100% which is almost 100% of heat ray transmitted through light-transmissive base body 171*a* and light transmissive elastic layer 171*d,* may be absorbed by heat ray absorbing layer 171*b,* and thereby, a roller member for heat ray fixing capable of heating instantly may be formed. The heat conductive rate of the heat absorbing layer 171*b* may be set (3 to 10)×$10^{-3}$ J/cm·s·K (a specific heat: (to 2.0)×J/g·K, a specific gravity: to 0.9)) relatively higher by adding an absorbing agent such as carbon black in comparison with the rubber layer (heat conductive rate: (1 to 3)×$10^{-3}$ J/cm·s·K, a specific heat: (1 to 2.0)×J/g·K, a specific gravity: to 0.9 to 1.0)) of the light transmissive elastic layer 171*d.* As the heat absorbing layer 171*b,* a metallic roller member such as a nickel electrocast roller may be provided with the same thickness. At this time, in order to absorb heat ray, it may be preferable to subject the inside (inner circumferential surface) to black oxidizing process. When the heat ray absorbing rate of the heat ray absorbing layer 171*b* is lower than 90% to be, for example, 20–80%, heat ray leaks, and when the heat ray fixing roller 17*a* is used for monochromatic image forming by the leaked heat ray, if black toner is stuck to the surface of the specific position of the heat ray fixing roller 17*a* by filming, heat generation is caused by leaked heat ray at the black toner sticking portion, and further heat generation is caused by further absorption of heat ray at that portion, thus, heat ray absorbing layer 171*b* is damaged. When used for color image forming, fixing failure or uneven fixing is caused because the absorbing rate of a color toner is generally low, and there is a difference of absorption efficiency between color toners. Therefore, the heat ray absorption rate of the heat ray absorbing layer 171*b* is made 90–100% which is almost 100%, preferably 95–100% so that heat rays transmitting the light transmissive base member 171*a* and the light transmissive elastic layer 171*d,* corresponding in amount to heat ray remaining after heat rays emitted from the halogen lamp 171*g* or the xenon lamp (not illustrated) absorbed by the light transmissive base member 171*a* and the light transmissive elastic layer 171*d,* are absorbed perfectly by the heat ray absorbing layer. Due to this, fusion of color toner which is difficult to be fixed by heat ray because of different spectral characteristics can be conducted satisfactorily, and in color image forming in FIG. 1, in particular, fusion of superposed color toner images on a transfer material on which a toner layer is thick which is difficult to be fixed by heat ray because of different spectral characteristics can be conducted satisfactorily. When a thickness of the heat ray absorbing layer 171*b* is thin to be less than 10 μm, damage and insufficient strength of the heat ray absorbing layer 171*b* are caused by local heating caused by a thin film, although heating speed owing to absorption of heat ray on the heat ray absorbing layer 171*b* is high, while, when a thickness of the heat ray absorbing layer 171*b* is thick to be more than 20 μm, insufficient heat conduction is caused and heat capacity grows greater, making instant heating to be difficult. By making the heat ray absorbing rate of the heat ray absorbing layer 171*b* to be 90–100% corresponding mostly to 100%, or preferably to be 95–100%, and by making a thickness of the heat ray absorbing layer 171*b* to be 10–500 μm, preferably to be 20–100 μm, local heat generation on the heat ray absorbing layer 171*b* can be prevented and uniform heat generation can be carried out. Further, since the wavelength of a heat ray projected on the heat ray absorbing layer 171*b* is 0.1–20 μm, preferably is 0.3–3 μm, it is also possible to form the heat ray absorbing layer 171*b* with those wherein fine particles of metal oxide such as titanium oxide, aluminum oxide, zinc oxide, silicon oxide, magnesium oxide, or calcium carbonate having heat ray transmissivity (mainly infrared ray transmissivity or far infrared ray transmissivity) of average particle size of not more than 1 μm, preferably of not more than 0.1 μm including primary and secondary particles having a particle size of not more than ½ or ⅕ of a wavelength of heat ray are dispersed, at the rate of 5–50% by weight, in resin hinders. Since the heat capacity of the heat ray absorbing layer 171*b* is made to be small in the manner stated above so that its temperature may rise quickly, it is possible to prevent problems that a temperature of heat ray fixing roller 17*a* representing a roller member for heat ray fixing falls, resulting in occurrence of uneven fixing. As the heat ray absorbing layer 171*b,* a material in which powder of carbon black, graphite, black iron oxide ($Fe_3O_4$), various ferrite and their compounds, oxidized copper, cobalt oxide and Indian red ($Fe_2O_3$) are mixed with a silicone rubber or a fluorine rubber each having an elasticity may be used. For example, the heat ray absorbing layer 171*b* (or double function layer 171B mentioned later) of the heat ray fixing roller 17*a,* when a fluorine resin (specific heat: 2.0 J/g·K, specific gravity: 0.9) having a layer thickness (a thickness) of 50 μm is provided on the surface (outer circumferential surface) of a light transmissive elastic layer 171*d* having an outer diameter of 50 mm, the heat capacity Q3 of the heat ray absorbing layer 171*b* (or double function layer 171B) for the A-3 size width (297 mm) is about 1.0 cal/deg. As the heat absorbing layer 171*b,* a metallic film member such as a nickel electrocast belt may be used. At this time, in order to absorb heat ray, it may be preferable to subject the inside (inner circumferential surface) to the black oxidizing process.

On the outer side (outer circumferential surface) of the heat ray absorbing layer 171*b,* there may be provided releasing layer 171*c* (heat conductive rate: (1 to 10)×$10^{-3}$ J/cm·s·K, specific heat: (to 2.0)×J/g·K, specific gravity: (to 0.9) which is covered with PFA (fluorine resin) tube having a thickness of 30–100 μm or is coated with fluorine resin (PFA or PTFE) coating to a thickness of 20–30 μm, to improve the property of releasing from toner (separation pattern).

As FIG. 4(*b*) shows a sectional view, a heat ray absorbing member wherein powder of carbon black, graphite, black iron oxide ($Fe_3O_4$), various ferrite and their compounds, oxidized copper, cobalt oxide and Indian red ($Fe_2O_3$) is mixed with fluorine resin (PFA or PTFE) coating serving as both binders and releasing agents to be combined, and multi function layer 171B having releasing property in which heat ray absorbing layer 171*b* and releasing layer 171*c* are integrated solidly is formed, as shown in FIG. 4(*a*), on the outer side (outer circumferential surface) of light transmissive elastic layer 171*d* formed on the outer side (outer circumferential surface) of light transmissive base member 171*a,* and thereby a roll-shaped roller member for heat ray fixing having elasticity is formed. As same as the heat conductive rate of the heat ray absorbing layer 171*b,* the heat conductive rate of the multi function layer 171B is (3–10)× $10^{-3}$ J/cm·s·K (specific heat: (to 2.0)×J/g·K, specific gravity: (to 0.9)). In the same way as in the foregoing, a heat ray absorbing rate of the multi function layer 171B is made to be 90–100% deserving almost 100%, preferably to be 95–100% so that heat ray emitted from the halogen lamp 171*g* or the xenon lamp (not illustrated) and transmitted through light transmissive base member 171*a* and elastic layer 171*d* may be absorbed completely. When the heat ray absorbing rate of the multi function layer 171B is lower than 90%, or is 20–80%, for example, heat ray leaks, and when the roller member for heat ray fixing is used for monochromatic image forming by the leaked heat ray, if black toner is stuck to the surface of the specific position of the roller member for heat ray fixing by filming, heat generation is caused by leaked heat ray at the black toner sticking portion, and further heat generation is caused repeatedly by further absorption of heat ray at that portion, thus, the multi function layer 171B is damaged. When used for color image forming, fixing failure or uneven fixing is caused because the absorbing rate of a color toner is generally low, and there is a difference of absorption efficiency between color toners. Therefore, the heat ray absorption rate of the multi function layer 171B is made to be 90–100% which is mostly about 100%, preferably to be 95–100 so that heat ray emitted from the halogen lamp 17*lg* or the xenon lamp (not illustrated) and transmitted through the light transmissive base member 171*a* may be absorbed completely in the roller member for heat ray fixing. Further, local heat generation on the multi function layer 171B can be prevented and uniform heat generation can be carried out. Further, since the wavelength of a heat ray projected on the multi function layer 171B is 0.1–20 μm. preferably is 0.3–3 μm, it is also possible to form the multi function layer 171B with those wherein fine particles of metal oxide such as titanium oxide, aluminum oxide, zinc oxide, silicon oxide, magnesium oxide, or calcium carbonate having heat ray transmissivity (mainly infrared ray transmissivity or far infrared ray transmissivity) of average particle size of not more than 1 μm, preferably of not more than 0.1 μm including primary and secondary particles having a particle size of not more than ½, preferably ⅕ of a wavelength of heat ray are dispersed in resin binders.

According to FIG. 5, since heat generation is concentrated at the heat ray absorbing layer 171*b* located at boundary by providing density distribution of the aforesaid heat ray absorbing member equally on the heat ray absorbing layer 171*b* of heat ray fixing roller 17*a,* heat tends to flow out to the light transmissive elastic layer-side. Therefore, it may be preferable to provide a member having a heat conductivity lower than the light transmissive base member 171*a* or density distribution from the view of dispersing the heat distribution. In an arrangement with regard to density distribution on the heat ray absorbing layer 171*b,* density on the boundary surface on the part of the elastic layer 171*d* which is inscribed is made to be low, then density is gradually raised toward the outer circumferential surface with a gradient, as shown in graph (I), and density is saturated to be the density for 100% absorption at the point just before the outer circumferential surface (the position corresponding to ⅔–⅘ of thickness t of heat ray absorbing layer 171*b* from the elastic layer 171*d*). Due to this, heat generation distribution caused by heat ray absorption on the heat ray absorbing layer 171*b* is formed to be in a shape of a parabola wherein the maximum value is positioned in the vicinity of the central portion of the heat ray absorbing layer 171*b* and the minimum value is positioned on the boundary surface of the heat ray absorbing layer 171*b* and in the vicinity of the outer circumferential surface as shown in graph (II). Or, it may be preferable to provide a light transmissive heat durable resin (polyimide, fluorine resin or silicone resin) having a thickness of 10 to 500 μm, preferably, 20 to 100 μm at a boundary surface or an outer circumferential surface of the heat ray absorbing layer 171*b.* Owing to this, heat generation caused by heat ray absorption on the aforesaid boundary surface is made small, and damage of an adhesion layer on the boundary surface and damage of the heat ray absorbing layer 171*b* can be prevented. Further, density distribution from this side (the position corresponding to ⅔–⅘ of thickness t of heat ray absorbing layer 171*b* from the light transmissive base member 171*a*) to the outer circumferential surface on the outer circumferential surface side is made to be saturated, so that no influence may be given even when the outer surface layer is shaved when multi function layer 171B is used, for example, and even when the multi function layer 171B is used, in particular. Incidentally, a saturated layer may be formed as is shown with dotted lines. In short, if absorption is conducted fully inside, there is not influence of density outside. Influence of shaving is not exerted either. It is further possible to give inclination to the density distribution and to adjust heat generation distribution by changing an angle of inclination.

The structure to attain the first object will be explained as follows. As shown in FIG. 6, when $\phi 1$ represents an outside diameter of cylindrical light transmissive base member 171*a* of heat ray fixing roller 17*a,* and t1 represents a thickness, a diameter ranging from 15 mm to 60 mm is used as diameter $\phi 1$ of the light transmissive base member 171*a,* and as thickness t1, a thicker one is better on the point of strength, while, a thinner one is better on the point of heat capacity. From relationship between the strength and heat capacity, the relationship between outside diameter $\phi 1$ of cylindrical light transmissive base member 171*a* and thickness t1 is made to be as follows, $$0.02 \leqq t1/\phi 1 \leqq 0.20$$

and it preferably is as follows.

$$0.04 \leqq t1/\phi 1 \leqq 0.10$$

For outside diameter $\phi 1$ of light transmissive base member 171*a* which is 40 mm, thickness t1 of light transmissive base member 171*a* satisfying 0.8 mm$\leqq$t1$\leqq$8 mm is used and that satisfying 1.6 mm$\leqq$t1$\leqq$4.0 mm is preferably used. When a value of t1/$\phi 1$ for light transmissive base member 171*a* is less than 0.02, insufficient strength is caused, and when a value of t1/$\phi 1$ exceeds 0.20, it causes greater heat capacity to make heating time to be longer for heat ray fixing roller 17*a.* Despite the light transmissive base member, some materials absorb heat rays of about 1–20%, and therefore, a base body that is as thinner as possible within a range to maintain strength is preferable.

A fixing unit which is highly resistant to deformation in a fixing section (nip portion) and is capable of doing quick start (quick heating) is made to be possible by using fixing unit 17 explained in FIG. 3, and further, color toner which is difficult to be fixed by heat rays due to different spectral characteristics can be fused satisfactorily through soft pressure in the fixing section (nip portion) by elasticity of the heat ray fixing roller member and through heating by a heat ray absorbing layer of the heat ray fixing roller member, thus, quick start (quick heating) fixing of color toner is made possible. An effect of energy conservation is also obtained.

In heat ray fixing roller 17*a,* however, a cylindrical glass member is mainly used as a material of light transmissive base member 171*a* of heat ray fixing roller 17*a.* Therefore, when a flange member into which a bearing member (bearing) is to be fitted is forced in the heat ray fixing roller 17*a* for trying to drive it, light transmissive base member 171*a* tends to crack, and it is difficult to drive the heat ray fixing roller 17*a.* In particular, there are needed the structure and conditions of a pressure rubber roller for improving fixing capability at nip portion N formed between the fixing roller and pressure rubber roller 47*a* that is provided to face the heat ray fixing roller 17*a.*

Figure 7:
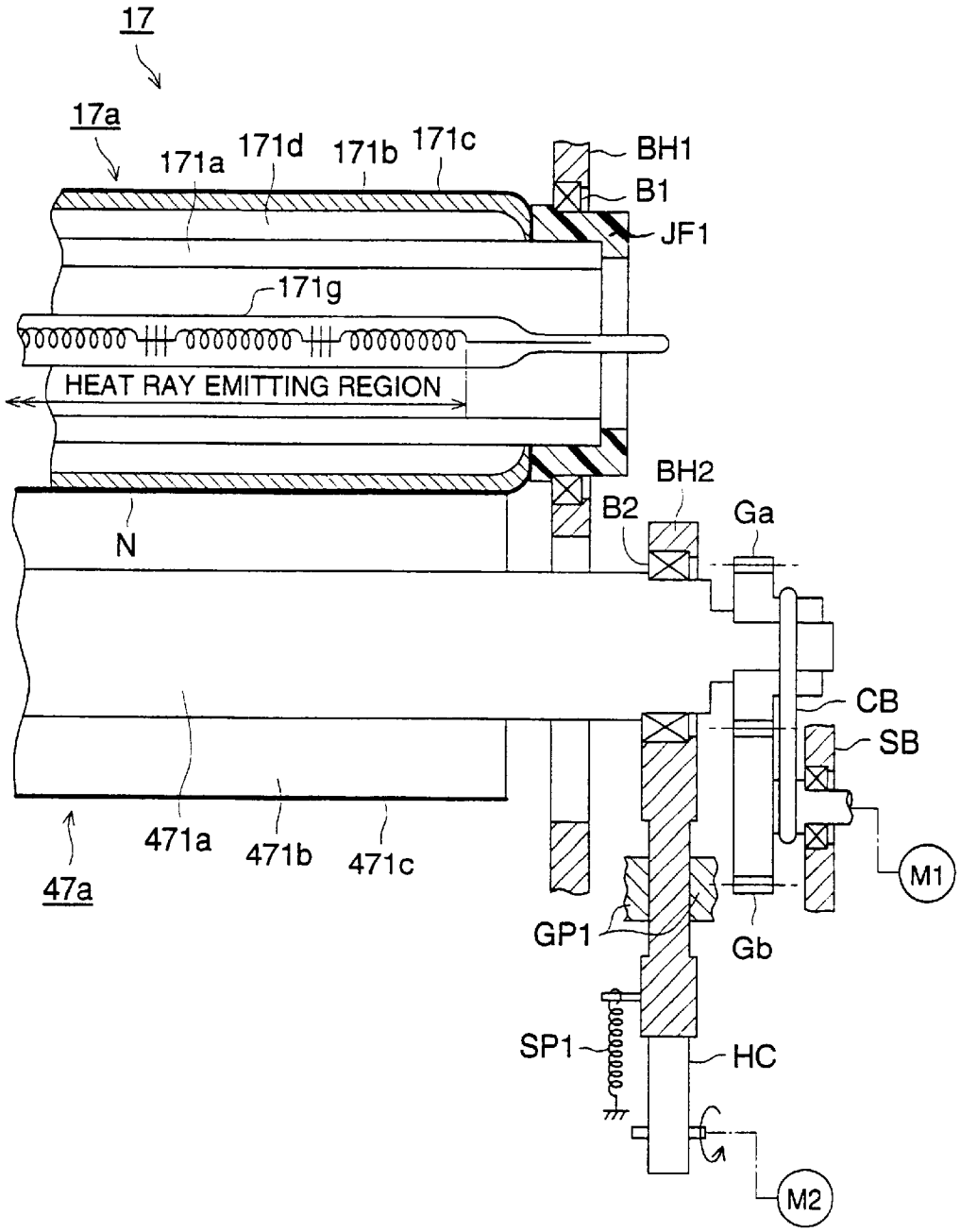
FIG. 7 is a side cross sectional view of the fixing apparatus in FIG. 3 to explain a structure to prevent breakage of the light transmitting base member and a structure and a condition of a pressure rubber roller.
Figure 8:
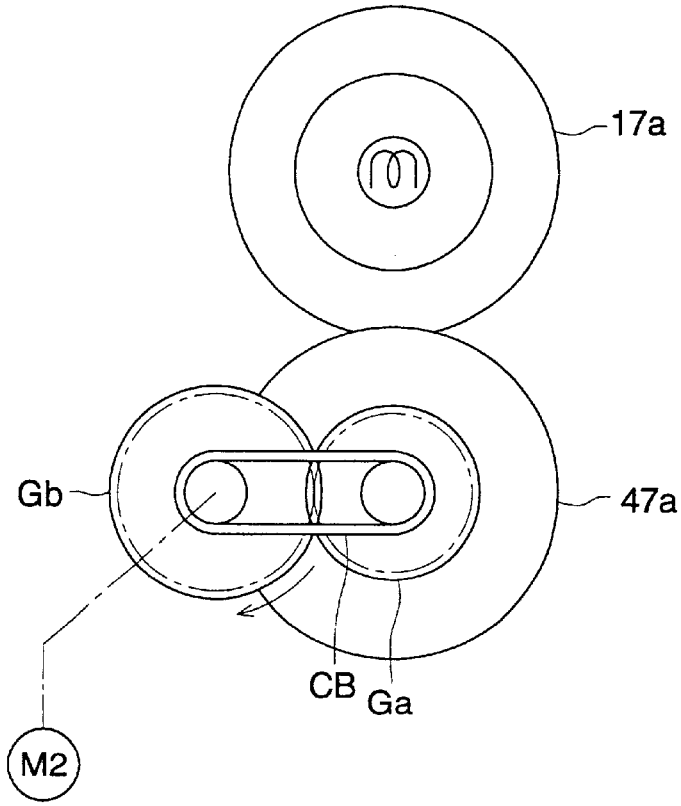
FIG. 8 is a diagram showing pressure-releasing operations for the pressure rubber roller.
Figure 9:
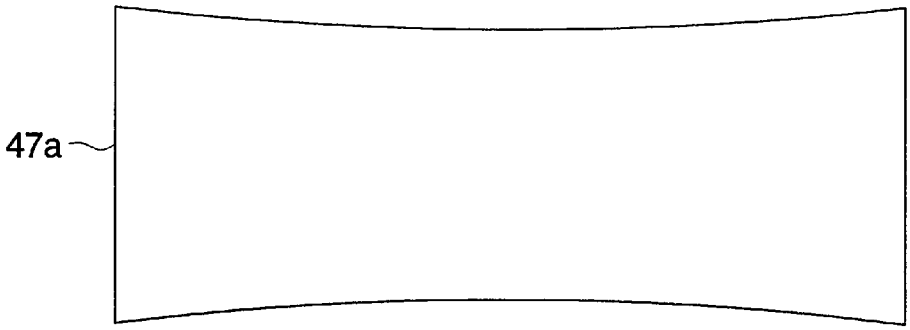
FIG. 9 is a diagram showing a preferable shape of the pressure rubber roller.
Figure 10:
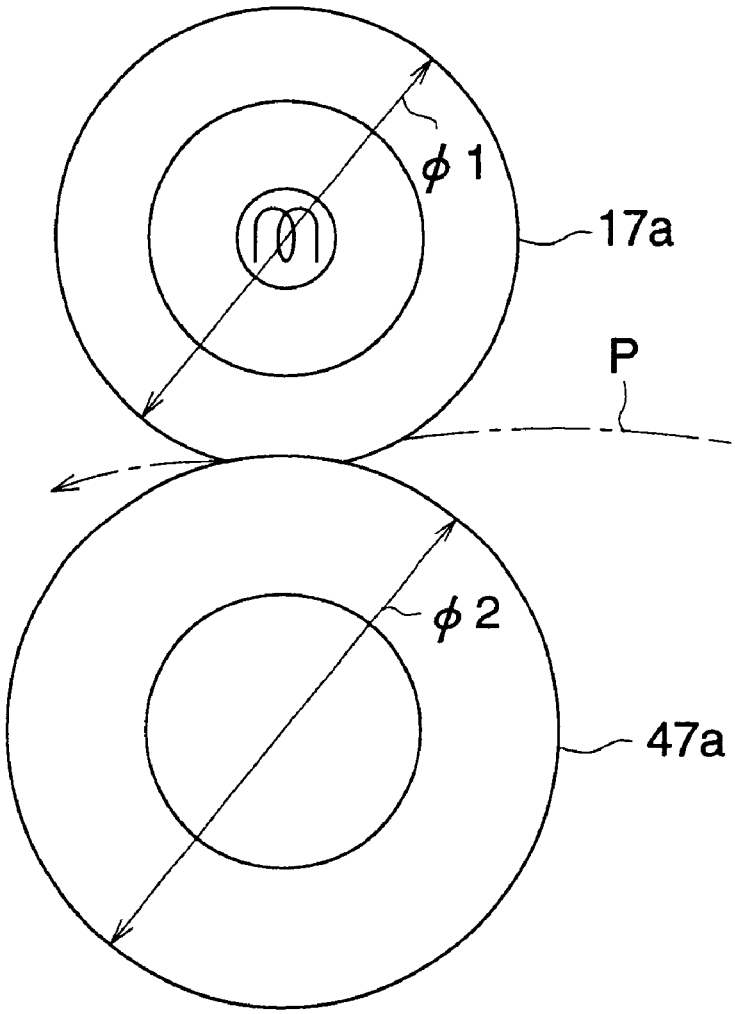
FIG. 10 is a diagram showing preferable conditions for outside diameters of a heat ray fixing roller member and the pressure rubber roller.

The structure to prevent damage of light transmissive base member 171*a* employing a glass member, and the structure and conditions for a pressure rubber roller for improving fixing capability will be explained, referring to FIGS. 7–10. FIG. 7 is a sectional side view of FIG. 3 which is for explaining the structure to prevent damage of the light transmissive base member and the structure and conditions for the pressure rubber roller, FIG. 8 is a diagram showing pressure-releasing operations for the pressure rubber roller, FIG. 9 is a diagram showing a preferable shape of the pressure rubber roller, and FIG. 10 is a diagram showing preferable conditions for outside diameters of a heat ray fixing roller member and the pressure rubber roller.

As a sectional side view of fixing unit 17 is shown in FIG. 7, heat ray fixing roller 17*a* is composed of light transmissive base member 171*a* which is provided, on its outer side (outer circumferential surface), with light transmissive heat elastic layer 171*d* and heat ray absorbing layer 171*b* in this order, and resin flange JF1 representing a rotary shaft employing a resin member such as, for example, heat-resistant polyimide resin is provided on each of both end portions on an outer circumferential surface of the light transmissive base member 171*a* to be in parallel with its central axis. The resin flange JF1 having the great rate of heat expansion provided at an end portion on an outer side (outer circumferential surface) of the light transmissive base member 171*a* prevents damage of the light transmissive base member 171*a* employing glass member mainly caused by its heat expansion that is generated when the light transmissive base member 171*a* is heated. The resin flange JF1 representing a rotary shaft is fitted in bearing B1 representing a bearing member which is to be forced in bearing holder BH1, thus, heat ray fixing roller 17*a* is supported to be rotatable.

With regard to pressure rubber roller 47*a* representing a lower fixing member constituted as a soft roller having elasticity formed by core metal 471*a,* rubber roller layer 471*b* and tube 471*c* such as heat-resistant fluorine resin, its both ends are fitted in bearings B2 which are forced in bearing holders BH2 provided on both ends, under the condition that the pressure rubber roller 47*a* is made by a pressure contact releasing means that conducts pressure contact and pressure contact releasing for the pressure rubber roller 47*a* to be in pressure contact with upper heat ray fixing roller 17*a* as will be described later, thus, the pressure rubber roller 47*a* is supported to be rotatable. Nip portion N whose upper side is convex (see FIG. 3) is formed between the upper soft roller having high elasticity and the lower soft roller having elasticity so that toner images are fixed.

Being driven by drive gear Gb that is provided on fixing side plate SB and is connected to fixing drive motor M1, gear Ga that is fixed on the end portion on one side of core metal 471*a* of the pressure rubber roller 47*a* and is engaged with drive gear Gb is rotated to rotate the pressure rubber roller 47*a,* thereby, the heat ray fixing roller 17*a* is driven to rotate. The drive gear Gb is connected with gear Ga by endless coupling belt CB.

As a condition that the pressure rubber roller 47*a* is fitted for a drive roller of the heat ray fixing roller 17*a,* rubber hardness of the pressure rubber roller 47*a* is established to be higher than that of the heat ray fixing roller 17*a.*

Owing to the foregoing, damage of light transmissive base member 171*a* employing a glass member mainly is prevented, a rubber roller layer of the pressure rubber roller is less deformed, the pressure rubber roller operates as a drive roller without slipping, and the heat ray fixing roller member rotates accurately.

Since the pressure rubber roller 47*a* is a drive roller for the heat ray fixing roller 17*a* as stated above and for the reason to make forming easy, it is preferable that the pressure rubber roller 47*a* is made to be in an inversed crown shape where in a middle portion is smaller in terms of diameter than both end portions. Due to this, when a transfer material enters a nip portion, both side end portions of the transfer material take the initiative in entering the nip portion, and the transfer material advances while it is spread out from its center portion, resulting in prevention of occurrence of fixing creases of the transfer material.

The pressure contact releasing means that conducts pressure contact and pressure contact releasing for the pressure rubber roller is shown in FIG. 7, wherein when eccentric cam HC rotated by pressure contact drive motor M2 provided on one side of fixing unit 17 arrives at an upper fulcrum, the eccentric cam HC pushes up the bottom of bearing holder BH2 while resisting the pulling force of spring SP1, thereby, the bearing holder BH2 goes up while sliding on guide surface GP1 to bring the pressure rubber roller 47*a* into pressure contact with heat ray fixing roller 17*a*. When the eccentric cam HC is rotated to move to the lower fulcrum by the electric control such as, for example, rotation of the pressure contact drive motor M2 made by reverse rotation signals for the pressure contact drive motor M2, or the rotation control for the pressure contact drive motor M2 made by signals of a micro switch (not shown) provided on a circumferential surface of the eccentric cam HC, or by mechanical rotation of the eccentric cam HC made by an operator, there is released the pressure contact between the heat ray fixing roller 17*a* and the pressure rubber roller 47*a*. Even in the case of pressure contact, the eccentric cam HC is rotated to move to the upper fulcrum by the electric control such as, for example, rotation of the pressure contact drive motor M2 made by reverse rotation signals for the pressure contact drive motor M2, or the rotation control for the pressure contact drive motor M2 made by signals of a microswitch (not shown) provided on a circumferential surface of the eccentric cam HC, or by mechanical rotation of the eccentric cam HC made by an operator, so that the heat ray fixing roller 17*a* and the pressure rubber roller 47*a* may be brought into pressure contact with each other, or pressure contact rotation of the pressure contact drive motor M2 may be stopped at a point of time when the force of pressure contact between the heat ray fixing roller 17*a* and the pressure rubber roller 47*a* arrives at a prescribed level (pressure contact releasing means which conducts pressure contact and pressure contact releasing).

In the case of the pressure contact or the pressure contact releasing stated above, gear Ga provided on the end portion of the pressure rubber roller 47*a* connected with drive gear Gb by coupling belt CB is rotated along an arc of the drive gear Gb (is made to be capable of being displaced in the are direction) on the center of the drive gear Gb for the pressure rubber roller 47*a*, and thereby, pressure contact or pressure contact releasing is conducted, as shown in FIG. 8. Due to this, pressure contact and pressure contact releasing for the pressure rubber roller can be conducted easily.

Further, it is preferable that light transmissive elastic layer 171*d* of the heat ray fixing roller 17*a* is within a range of 0.5 mm–10 mm, preferably of 2 mm–5 mm, in terms of thickness, and a thickness of a rubber roller layer of the pressure rubber roller 47*a* is not less than 2 mm which is thicker than that of the light transmissive elastic layer 171*d* of the heat ray fixing roller 17*a*, preferably, not more than 10 mm. Due to this, a wide nip portion is formed, and rotation of a heat ray fixing roller member that is driven to rotate can be made satisfactorily.

As a first condition of the pressure rubber roller 47*a*, rubber hardness of heat ray fixing roller 17*a* is decided by rubber hardness of light transmissive elastic layer 171*d* constituting the heat ray fixing roller 17*a* as described earlier in FIG. 4, and it is within a range of 5 Hs–60 Hs (rubber hardness A in JIS). However, it is preferable that rubber hardness of the pressure rubber roller 47*a* is set to 80 Hs (rubber hardness A in JIS) or lower and preferably not lower than 20 Hs, to be higher than that of the heat ray fixing roller 17*a*. When rubber hardness of the pressure rubber roller 47*a* is too high to exceed 80 Hs, there is a fear that the heat ray fixing roller 17*a* whose rubber hardness is lower may be damaged, while when hardness of the pressure rubber roller 47*a* is too low to be less than 20 Hs, soft rubber roller layer 471*b* is subjected to polarized thickness to cause slippage.

Due to the foregoing, there is formed a nip portion wherein no slip is caused and excellent fixing power is obtained.

As a second condition of the pressure rubber roller 47*a*, diameters ranging from 15 mm to 60 mm are used as outside diameter ($\phi 1$) of the heat ray fixing roller 17*a* as described earlier in FIG. 6, and it is preferable that an outside diameter of the heat ray fixing roller 17*a* and that of the pressure rubber roller 47*a* both used are the same in terms of dimension, and outside diameter ($\phi 2$) of the pressure rubber roller 47*a* is not more than 60 mm, and a width of nip portion N formed by the pressure rubber roller and the heat ray fixing roller 17*a* is set to be 15 mm or less and preferably not less than 5 mm. When an outside diameter of the pressure rubber roller 47*a* is too large to exceed 60 mm, heat of the heat ray fixing roller 17*a* is taken in the pressure rubber roller 471*a*, resulting in a longer period of time for temperature rise of the heat ray fixing roller 17*a*. When an outside diameter of the pressure rubber roller 471*a* is too small, it is impossible to make a width of a nip portion to be large.

Due to the foregoing, there is formed a nip portion wherein excellent fixing power is obtained.

As a third condition of the pressure rubber roller 47*a*, it is preferable that an outside diameter of the pressure rubber roller 47*a* is set to be 60 mm or less and a thickness of rubber roller layer 471*b* of the pressure rubber roller 47*a* is set to be 2 mm or more, preferably 10 mm or less, so that outside diameter ($\phi 2$) of the pressure rubber roller 47*a* is made to be small and a width of nip portion N is made to be large.

Due to the foregoing, there is formed a nip portion wherein excellent fixing power is obtained.

In FIG. 10, a leading edge of recording sheet P hits heat ray fixing roller 17*a* to be advanced, and the recording sheep P passes through nip portion N. When an outside diameter of the heat ray fixing roller 17*a* is represented by $\phi 1$ and that of the pressure rubber roller 47*a* is represented by $\phi 2$, it is preferable to set to satisfy $\phi 1<\phi 2$, for improving parting characteristics in separation of recording sheet P fixed in the nip portion N formed between the heat ray fixing roller 17*a* and the pressure rubber roller 47*a* and for making temperature rise of the heat ray fixing roller 17*a* to be more quick. Namely, outside diameter $\phi 1$ of the heat ray fixing roller 17*a* is made to be small to reduce heat capacity, and a quantity of heat generation on the surface is made to be large to shorten a period of time for temperature rise of the heat ray fixing roller 17*a* (to shorten warming up time). Further, by making outside diameter $\phi 1$ of the heat ray fixing roller 17*a* to be small and by making a curvature of the heat ray fixing roller 17*a* at a parting position for a transfer material on the nip portion N to be large, the parting characteristic in separation of recording sheet P fixed in nip portion N formed between the heat ray fixing roller 17*a* and the pressure rubber roller 47*a* is further improved. On the other hand, since fixing capability is deteriorated when outside diameter $\phi 1$ of the heat ray fixing roller 17*a* is made small, outside diameter $\phi 2$ of the pressure rubber roller 47*a* is made large to make a width of nip portion N to be large.

Further, it is preferable, from the viewpoint of the speed of temperature rise and parting characteristic, that $\phi 1/\phi 2$ which is a ratio of outside diameter $\phi 1$ of the heat ray fixing roller 17*a* to outside diameter $\phi 2$ of the pressure rubber roller 47*a* is set to satisfy $0.5 \leqq \phi 1/\phi 2 \leqq 0.9$. When $\phi 1/\phi 2$ representing the ratio of outside diameter $\phi 1$ of the heat ray fixing roller 17*a* to outside diameter ϕ2 of the pressure rubber roller 47*a* is small to be less than 0.5, a width of the nip portion N is too narrow, and fixing capability is worsened. When ϕ1/ϕ2 representing the ratio of outside diameter ϕ1 of the heat ray fixing roller 17*a* to outside diameter ϕ2 of the pressure rubber roller 47*a* is large to exceed 0.9, parting characteristic in separation of recording sheet P to be fixed in the nip portion N formed between the heat ray fixing roller 17*a* and the pressure rubber roller 47*a* is deteriorated and the speed of temperature rise of the heat ray fixing roller 17*a* is lowered.

Owing to the foregoing, temperature rise of a heat ray fixing roller member is accelerated, and parting characteristic in separation of a transfer material which is to be fixed in the nip portion formed between the heat ray fixing roller member and the pressure rubber roller is further improved.

The structure to attain the second object will be explained as follows.

Figure 11:
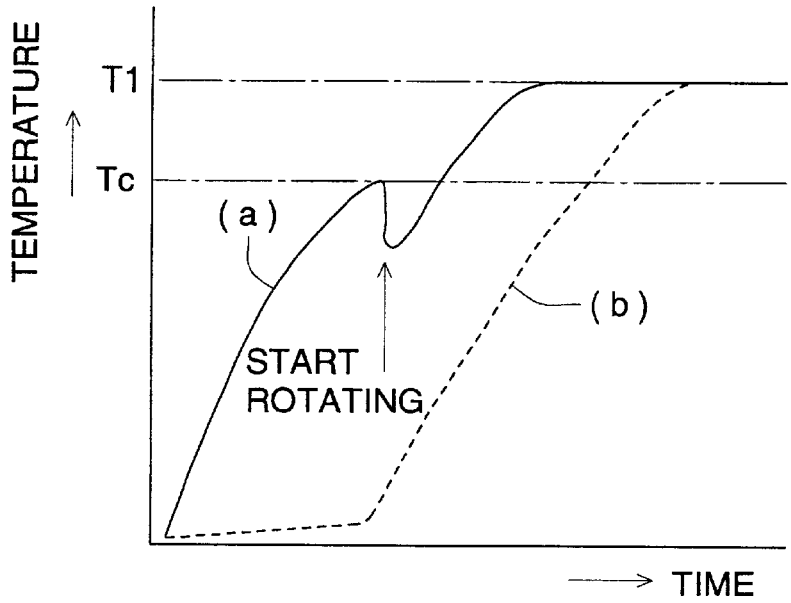
FIG. 11 is a diagram showing the time for the heat ray fixing roller member to start rotating and temperature rise curves of the heat ray fixing roller member and the pressure rubber roller.
Figure 12:
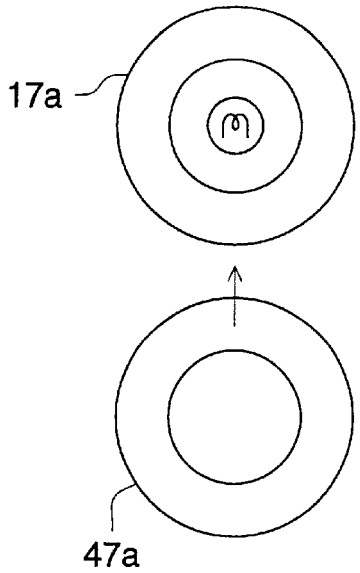
FIGS. 12(*a*) and 12(*b*) are illustrations explaining how the heat ray fixing roller member and the pressure rubber roller start rotating.
Figure 12:
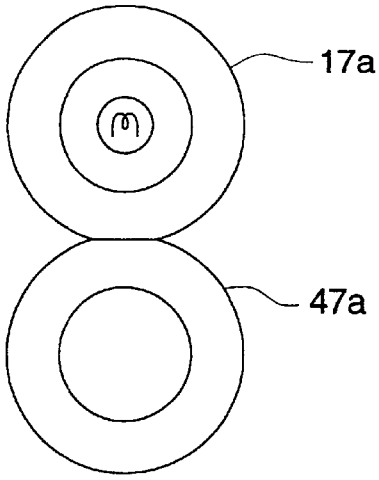
Figure 13:
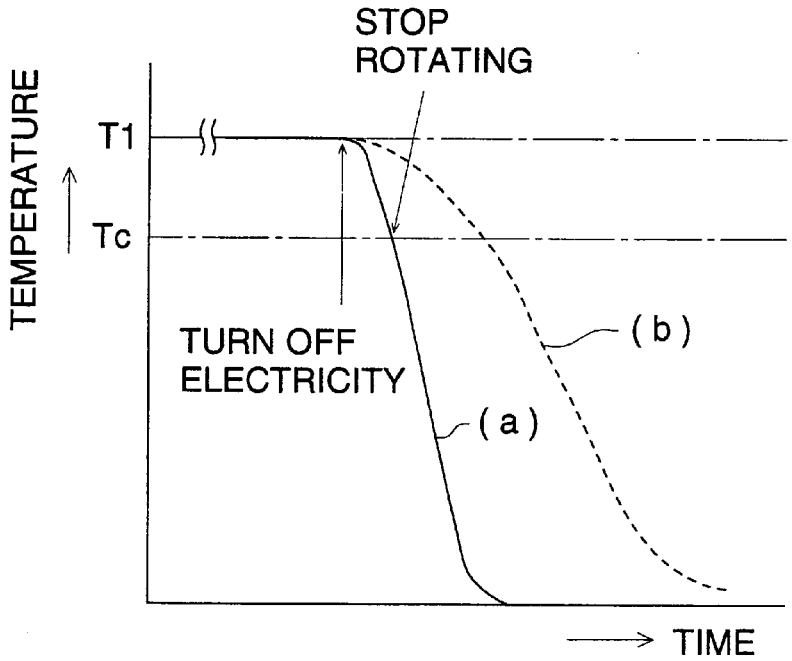
FIG. 13 is a diagram showing the time for the heat ray fixing roller member to stop rotating and temperature fall curves of the heat ray fixing roller member and the pressure rubber roller.
Figure 14:
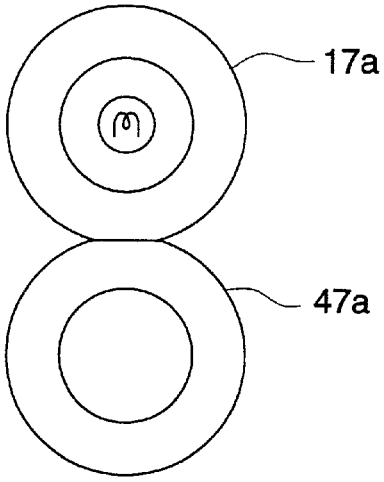
FIGS. 14(*a*) and 14(*a*) are illustrations explaining how the heat ray fixing roller member and the pressure rubber roller stop rotating.
Figure 14:
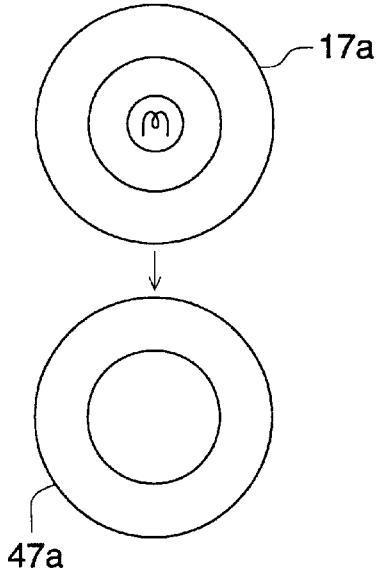

Prevention of flowing out of heat from the energized heat ray fixing roller member to the pressure rubber roller, prevention of deterioration of the heat ray fixing roller member and the pressure rubber roller caused by contact between the heat ray fixing roller member that is not energized and the pressure rubber roller, and prevention of exfoliation of a heat ray absorbing layer on a boundary surface from a light transmissive elastic layer will be explained, referring to FIG. 7 and FIGS. 11–14. FIG. 7 is a sectional side view of the fixing unit in FIG. 3 for explaining how the heat ray fixing roller member is driven and for explaining a pressure contact releasing mechanism for the pressure rubber roller. FIG. 11 is a diagram showing the time for the heat ray fixing roller member to start rotating and temperature rise curves of the heat ray fixing roller member and the pressure rubber roller, FIGS. 12(A) and 12 (B) are illustrations explaining how the heat ray fixing roller member and the pressure rubber roller start rotating, FIG. 13 is a diagram showing the time for the heat ray fixing roller member to stop rotating and temperature fall curves of the heat ray fixing roller member and the pressure rubber roller, and FIGS. 14(A) and 14(B) are illustrations explaining how the heat ray fixing roller member and the pressure rubber roller stop rotating.

In the present embodiment, for the purpose to prevent flowing out of heat from heat ray fixing roller 17*a* to pressure rubber roller 47*a* in the course of energizing and thereby to achieve a speedup for temperature rise of the heat ray fixing roller 17*a,* rotation of the heat ray fixing roller 17*a* caused by its contact with the pressure rubber roller 47*a* is started when the temperature of the heat ray fixing roller 17*a* arrives at prescribed temperature (Tc) or higher, when the heat ray fixing roller 17*a* is energized.

Namely, as shown in FIG. 11, the pressure rubber roller 47*a* is driven so that rotation of the heat ray fixing roller 17*a* is started at a point of time when the temperature of the heat ray fixing roller 17*a* shown with temperature rise curve (a) arrives at prescribed temperature Tc. On the heat ray fixing roller 17*a* that uses heat generation on the surface of heat ray absorbing layer 171*b,* the temperature fall that is lower than prescribed temperature Tc is caused by the contact with a circumferential surface of pressure rubber roller 47*a* that is caused by rotation of the pressure rubber roller 47*a,* as shown in curve (a). Therefore, the pressure rubber roller 47*a* is rotated from the position of prescribed temperature Tc where the rotation of the heat ray fixing roller 17*a* is started, and there is needed preliminary heating of the pressure rubber roller 47*a* which is conducted before the heat ray fixing roller 17*a* whose temperature rise is shown on curve (b) arrives at appropriate fixing temperature T1. The heating is just for the surface of the pressure rubber roller 47*a,* which does not cause temperature fall in the course of fixing, without heating up to the inside of the pressure rubber roller 47*a,* and no rotation is made until the heat ray fixing roller 17*a* arrives at prescribed temperature Tc.

To be concrete, since it is preferable, because of no flowing out of heat, that the pressure rubber roller 47*a* is away from the heat ray fixing roller 17*a* in the course of temperature rise, it is preferable that pressure contact of the pressure rubber roller 47*a* is released by the pressure contact releasing mechanism described in FIG. 7 in advance as shown in FIG. 12(A), and the rotation of the heat ray fixing roller 17*a* is conducted by pressure contact and rotation of the pressure-contact-released pressure rubber roller 47*a.* Further, even when the pressure rubber roller 47*a* is in contact, heat diffusion is poor (a level of heat flowing out is low) and a speed of temperature rise is less affected, because rubber roller layer 471*b* (see FIG. 3) is provided on the surface of the pressure rubber roller 47*a.* Therefore, it is also possible that the pressure rubber roller 47*a* is brought into pressure contact in advance by a pressure contact releasing mechanism as shown in FIG. 14(B) and rotation of the heat ray fixing roller 17*a* is conducted by rotation of the pressure rubber roller 47*a* that is in pressure contact.

Due to the foregoing, heat flowing out from the heat ray fixing roller member to the pressure rubber roller in the course of energizing is prevented, and a speedup for temperature rise of the heat ray fixing roller member is achieved.

In the present embodiment, deterioration of the heat ray fixing roller 17*a* and the pressure rubber roller 47*a* caused by contact between them in the course of no energizing is prevented, and exfoliation of heat ray absorbing layer 171*d* (see FIG. 3) of the heat ray fixing roller 17*a* from light transmissive elastic layer 171*d* (see FIG. 3) on their boundary surface is prevented. Therefore, rotation of the heat ray fixing roller 17*a* is stopped (print is completed) after energizing to the heat ray fixing roller 17*a* is stopped.

Namely, as shown in FIG. 13, rotation of the heat ray fixing roller 17*a* is stopped at a point of time when the temperature of the heat ray fixing roller 17*a* whose temperature fall after the stop of energizing is shown with curve (a) arrives at prescribed temperature Tc. After energizing is stopped, temperature on the surface (surface temperature on the circumferential surface excluding a nip portion) of the heat ray fixing roller 17*a* falls immediately when it is rotated slightly. Namely, since heat capacity of the heat ray fixing roller 17*a* is small although its surface temperature is high, temperature on the surface (surface temperature on the circumferential surface excluding a nip portion) of the heat ray fixing roller 17*a* falls immediately, due to heat diffusion to the pressure rubber roller 47*a* and to light transmissive base member 171*a* of the heat ray fixing roller 17*a.* The surface temperature of the pressure rubber roller 47*a* after the stop of energizing follows the temperature fall shown on curve (b).

To be concrete, as shown in FIG. 14(A), the pressure rubber roller 47*a* is made by the aforesaid pressure contact releasing mechanism to be in pressure contact in advance, and when the temperature of the heat ray fixing roller 17*a* arrives at prescribed temperature Tc stated above in FIG. 13, rotation of the pressure rubber roller 47*a* is stopped to stop rotation of the heat ray fixing roller 17*a.* Further, as shown in FIG. 14(B), it is also possible to release pressure contact of the pressure rubber roller 47*a* that is brought into pressure contact by the aforesaid pressure contact releasing mechanism in advance to stop rotation of the heat ray fixing roller 17*a.*

Due to the foregoing, there are prevented deterioration of the heat ray fixing roller member and deterioration and deformation of the pressure rubber roller 47*a* both caused by contact between them in the course of no energizing. In particular, there is prevented exfoliation of a heat ray absorbing layer having remarkable temperature rise on a boundary surface from a light transmissive elastic layer.

Figure 15:
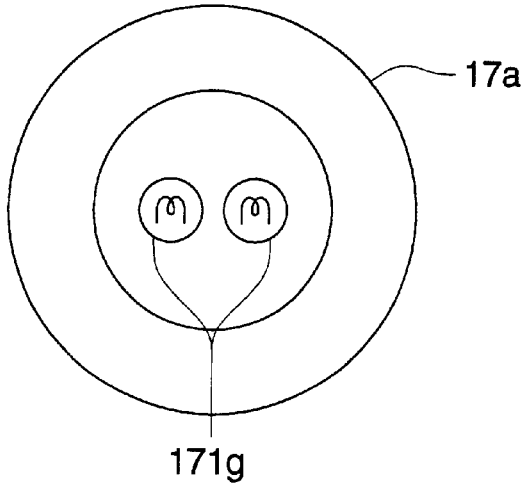
FIG. 15 is a diagram showing how plural heat ray irradiating means are arranged inside a heat ray fixing roller member.
Figure 16:
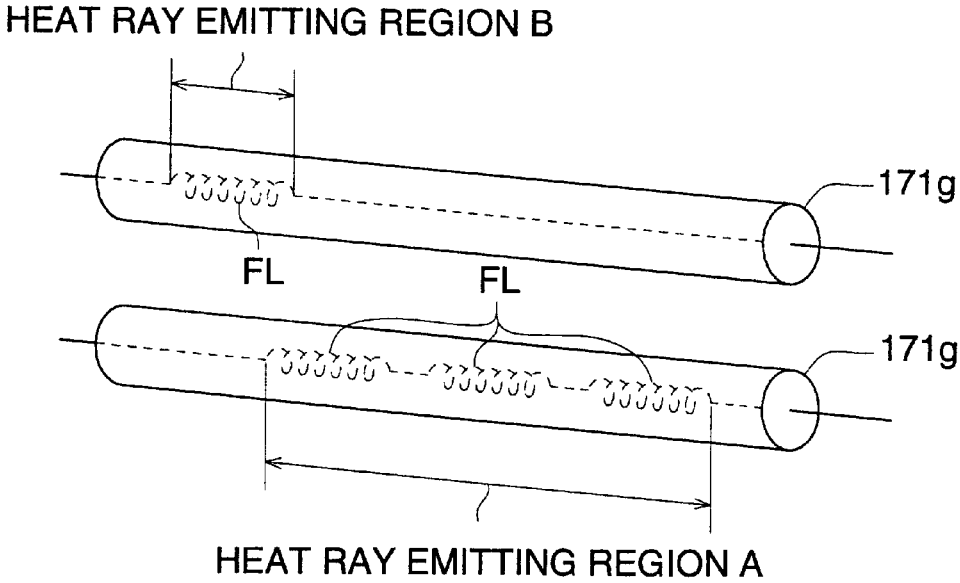
FIG. 16 is a perspective view of the heat ray irradiating means in FIG. 15.
Figure 17:
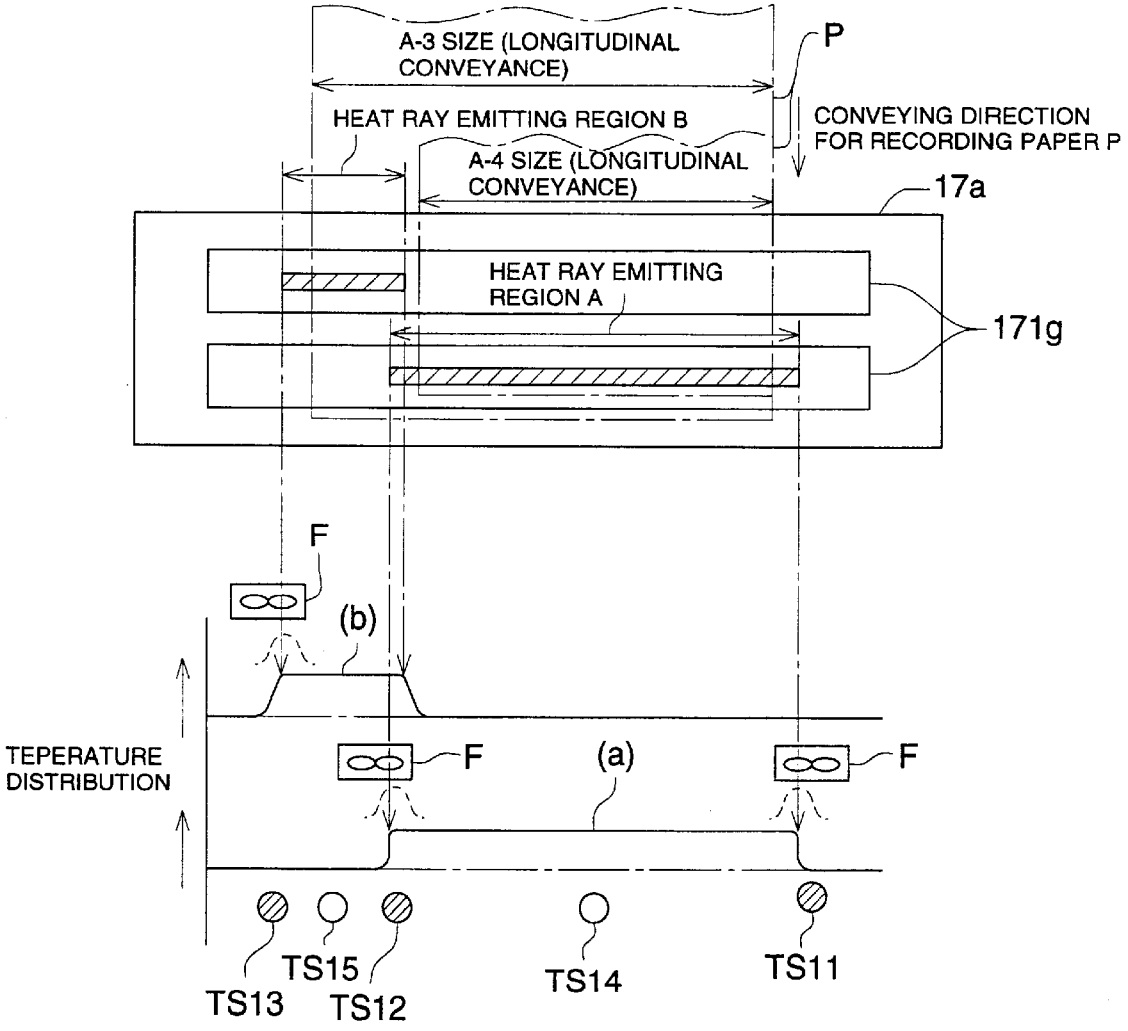
FIG. 17 is an illustration showing a fixing method for various transfer material sizes by a heat ray fixing roller member having plural heat ray irradiating means, and cooling of an end portion of a heat ray emitting area of the heat ray fixing roller member having plural heat ray irradiating means.
Figure 18:
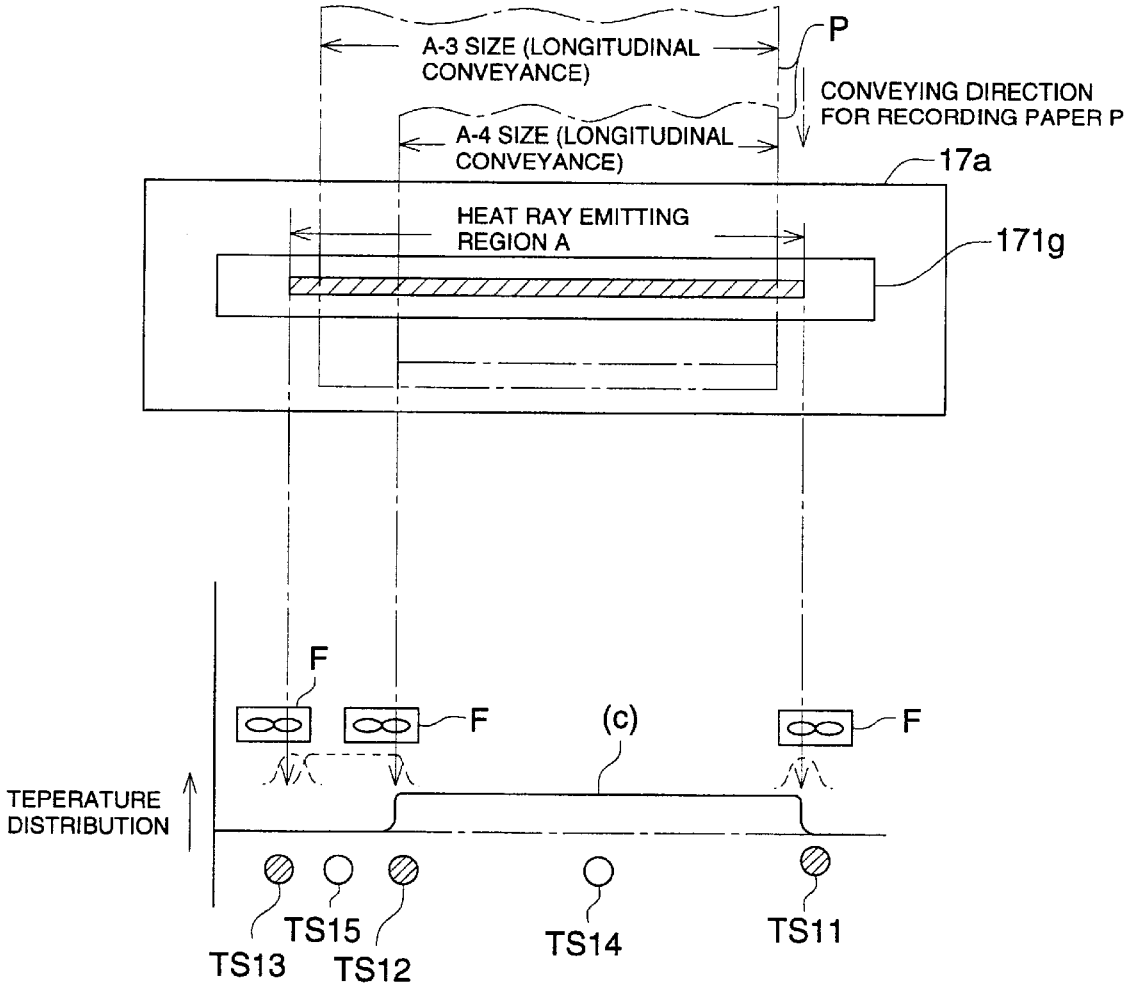
FIG. 18 is an illustration showing a fixing method for various transfer material sizes by a heat ray fixing roller member having one heat ray irradiating means, and cooling of an end portion of a heat ray emitting area of the heat ray fixing roller member having plural heat ray irradiating means.
Figure 19:
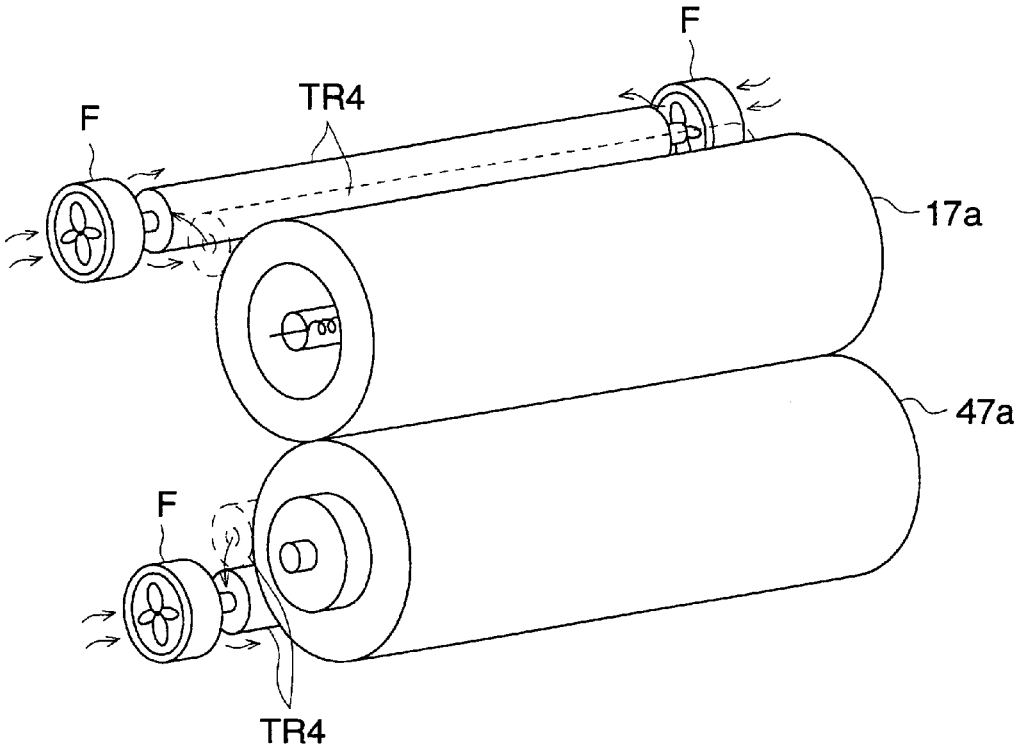
FIG. 19 is a diagram showing a further preferable method for equalizing heat of a heat ray fixing roller member and a pressure rubber roller by a heat equalizing roller.

Referring to FIGS. 15–19, there will be explained an embodiment wherein uneven fixing caused by a difference in sizes of transfer materials is prevented by equalizing thermal conductivity in the lateral direction (direction perpendicular to the conveyance direction of a transfer material) of a heat ray fixing roller member. FIG. 15 is a diagram showing how plural heat ray irradiating means are arranged inside a heat ray fixing roller member, FIG. 16 is a perspective view of the heat ray irradiating means in FIG. 15, FIG. 17 is an illustration showing a fixing method for various transfer material sizes by a heat ray fixing roller member having plural heat ray irradiating means, and cooling of an end portion of a heat ray emitting area of the heat ray fixing roller member having plural heat ray irradiating means, FIG. 18 is an illustration showing a fixing method for various transfer material sizes by a heat ray fixing roller member having one heat ray irradiating means, and cooling of an end portion of a heat ray emitting area of the heat ray fixing roller member having plural heat ray irradiating means, and FIG. 19 is a diagram showing a further preferable method for equalizing heat of a heat ray fixing roller member and a pressure rubber roller by a heat equalizing roller.

Recording sheet P representing a transfer material is conveyed with one side of heat ray fixing roller 17*a* representing a heat ray fixing roller member serving as a reference, as will be described in detail in FIG. 17, and as a preferable method for preventing uneven fixing caused by a difference in sizes of transfer materials by equalizing thermal conductivity in the lateral direction (direction perpendicular to the conveyance direction of a transfer material), halogen lamps 171*g* representing two heat ray irradiating means are arranged in parallel inside the heat ray fixing roller 17*a* as shown in FIG. 15. As shown in FIG. 16, on halogen lamp 171*g* on one side (lower halogen lamp 171*g* in FIG. 8), there is formed heat ray emitting area A by providing heat ray filament FL representing a heat ray emitting source on an area corresponding to the size of a transfer material that is mainly used, while, on halogen lamp 171*g* on the other side (upper halogen lamp 171*g* in FIG. 8), there is formed heat ray emitting area B by providing heat ray filament FL representing a heat ray emitting source on an end portion.

For preventing uneven fixing caused by a difference in sizes of transfer materials by equalizing thermal conductivity in the lateral direction (direction perpendicular to the conveyance direction of a transfer material), plural (two) heat ray irradiating means mentioned above are subjected to heating control in accordance with a size of a transfer material, and plural (two) heat ray irradiating means each having a different heat ray emitting area or each having a different distribution of intensity of heat ray emitting, are used to control so that temperature distribution in the lateral direction (direction perpendicular to the conveyance direction for a transfer material) of the heat ray fixing roller member may be uniformed.

Namely, as shown in FIG. 17, recording sheet P in A-4 size is fixed by the lighted halogen lamp 171*g* on one side having heat ray emitting area A covering a width (210 mm) of a size used mainly, for example, A-4 size of recording sheet P representing a transfer material conveyed with one side of heat ray fixing roller 17*a* serving as a reference and having temperature distribution of heat ray fixing roller 17*a* shown with solid lines (a). A size of recording sheet P representing a transfer material used mainly, for example, a width (210 mm) of A-4 size for longitudinal feeding is set to be narrower than a width of heat ray emitting area A, so that recording sheet P may be fixed sufficiently in its full width at heat ray emitting area A. Further, when a size of recording sheet P representing a transfer material conveyed along one side of heat ray fixing roller 17*a* serving as a reference is larger than a width of heat ray emitting area A that is for fixing recording sheet P in A-4 size for longitudinal feeding, for example, when fixing the recording sheet P with a width of A-3 longitudinal feeding size (297 mm that is the same as a width of A-4 lateral feeding size), halogen lamp 171*g* on the other side having heat ray emitting area B and temperature distribution of heat ray fixing roller 17*a* shown with solid lines (b) is further lit, and the large-sized recording sheet P in A-3 longitudinal feeding size is fixed by the heat ray fixing roller 17*a* which is composed of heat ray emitting areas A and B and has temperature distribution formed by solid lines (a) and (b). A width (297 mm) of recording sheet P in A-3 longitudinal feeding size is set to be narrower than a width of the composed area including heat ray emitting areas A and B, so that large-sized recording sheet P may be fixed sufficiently in its full width in the composed area including heat ray emitting areas A and B.

In the foregoing, it is also possible to control by using plural (two) heat ray irradiating means each having different distribution of heat ray emission intensity so that temperature distribution in the lateral direction (direction perpendicular to the conveyance direction for a transfer material) of a heat ray fixing roller member may be made uniform.

Due to the foregoing, plural (two) heat ray irradiating means are controlled so that temperatures in a wide range may be leveled constantly, heat in the lateral direction (direction perpendicular to the conveyance direction for a transfer material) of a heat ray fixing roller member is made uniform, and thereby, quick start (quick heating) fixing which corresponds to a size of a transfer material and is free from uneven fixing is made possible.

As shown in FIG. 17, when halogen lamp 171*g* having heat ray emitting area A is lit and printing for small-sized recording sheet P in A-4 longitudinal feeding size corresponding to the width of the heat ray emitting area A is conducted continuously, there are generated temperature rises shown with dotted lines to be convex on non-sheet-conveyance portions on both end portions of temperature distribution shown with solid lines (a), thereby, heat ray fixing roller 17*a* and pressure rubber roller 47*a* both on the temperature-risen portions are deteriorated, and fixing offset is caused on a boundary on temperature distribution between solid line (b) and solid line (a) when printing for recording sheet P is conducted by switching to the A-3 longitudinal feeding size. Therefore, fans F representing a cooling means are provided on portions which are both end portions of heat ray emitting area A and are both end portions of the temperature distribution shown with solid lines (a) (also both end portions of recording sheet P in A-4 longitudinal feeding size) to cool the heat ray fixing roller 17*a*. Further, when halogen lamp 171*g* having heat ray emitting area B is lit and printing for recording sheet P in A-3 longitudinal feeding size is conducted continuously, there is generated temperature rise on non-sheet conveyance portion shown with dotted lines to be convex even on a left end portion in FIG. 9 on temperature distribution shown with solid lines (b), and heat ray fixing roller 17*a* and pressure rubber roller

47*a* both on the temperature-risen portion are deteriorated, and fixing offset is caused on a boundary on temperature distribution between solid line (b) and solid line (a) when printing for recording sheet P is conducted by switching to the A-3 longitudinal feeding size. Therefore, fan F representing a cooling means is provided on the portion which is a left end portion of heat ray emitting area B and is a left end portion of the temperature distribution shown with solid lines (b) (also a left end portion of recording sheet P in A-3 longitudinal feeding size) to cool the heat ray fixing roller 17*a*. Namely, fans F serving as a cooling means are provided on both end portions of a composed area including heat ray emitting areas A and B which are also both end portions of the composed temperature distribution shown with solid lines (a) and (b) (also both end portions of recording sheet P in A-3 longitudinal feeding size), to cool the heat ray fixing roller 17*a*.

Due to the foregoing, there is prevented deterioration of a heat ray fixing roller member and a pressure rubber roller both caused by temperature rise on non-sheet-conveyance sections which are different for each size of a transfer material, and there is prevented fixing offset for the large size caused by temperature rise on non-sheet-conveyance sections.

The temperature control stated above is conducted by temperature sensors TS11, TS12 and TS13 representing plural (more than two) temperature detection means provided to be in contact or non-contact with heat ray fixing roller 17*a* in its axial direction in the outer side of the heat ray fixing roller 17*a,* in accordance with both end portions of heat ray emitting area A (both end portions of a width of A-4 longitudinal feeding size) and a left end portion of heat ray emitting area B (left end portion of a width of A-3 longitudinal feeding size). In addition, temperature sensor TS14 representing a temperature detection means is provided at a central position of A-4 longitudinal feeding size area corresponding to heat ray emitting area A, and temperature sensor TS15 representing a temperature detection means is provided to face heat ray fixing roller 17*a* at a position that is outside A-4 longitudinal feeding size area and is inside A-3 longitudinal feeding size area, and control is made through an unillustrated control section so that image forming on large-sized recording sheet P in A-3 longitudinal feeding size is prohibited (when the temperature of the heat ray fixing roller 17*a* detected by the temperature detection means is the stipulated value or more, image forming on a large-sized transfer material size including the temperature detection means arrived at the stipulated value or more is prohibited) when the temperature detected by temperature sensor TS15 exceeds an appropriate temperature value for fixing, for example, and arrives at a temperature that is higher than the stipulated temperature which causes high temperature offset. Further, image forming on a large-sized transfer material size including the temperature detection means arrived at the stipulated value or more is prohibited until the temperature of the heat ray fixing roller 17*a* is made uniform.

Due to the foregoing, fixing offset on a large size caused by temperature rise on the non-sheet-conveyance portion that differs depending on a size of a transfer material is prevented, and appropriate fixing in accordance with a size of a transfer material is conducted.

In FIG. 17, the invention also includes that sizes of transfer materials to be used are made to be 3 types or more by adding, for example, B-5 longitudinal feeding size and B-4 longitudinal feeding size (same width as that of B-5 lateral feeding size), and heat ray emitting means having heat ray emitting areas corresponding to the three types or more are provided to control temperature in accordance with sizes of transfer materials, and that temperature detection means including various sizes are provided, and when the temperature of a heat ray fixing roller member detected by the temperature detection means arrives at a stipulated value or more, image forming on large transfer material size including the temperature detection means arrived at the stipulated value or more is prohibited.

As shown in FIG. 18, recording sheet P in A-3 longitudinal feeding size (297 mm width that is the same as that of A-4 lateral feeding size) or recording sheet P in A-4 longitudinal feeding size (210 mm) are fixed by one lighted halogen lamp 171*g* having heat ray emitting area C corresponding to the maximum size of recording sheet P representing a transfer material conveyed along one side of the heat ray fixing roller 17*a* serving as a reference, for example, to A-3 longitudinal feeding size width (297 mm) and having temperature distribution or the heat ray fixing roller 17*a* shown with solid lines (c). The maximum size width of recording sheet P (A-3 longitudinal feeding size width in the present embodiment) is set to be narrower than a width of the heat ray emitting area C, so that recording sheet P may be fixed sufficiently in its full width at the heat ray emitting area C.

When halogen lamp 171*g* having heat ray emitting area C is lit and printing for small-sized recording sheet P in A-4 longitudinal feeding size is conducted continuously, there are generated temperature rises shown with dotted lines to be convex on both end portions of sheet-conveyance section for A-4 longitudinal feeding size having temperature distribution shown with solid lines (c), thereby, heat ray fixing roller 17*a* and pressure rubber roller 47*a* are deteriorated, and fixing offset is caused on the temperature-risen portion on the left end portion corresponding to the sheet-conveyance section for A-4 longitudinal feeding size when printing for recording sheet P is conducted by switching to the A-3 longitudinal feeding size. Therefore, fans F representing a cooling means are provided on portions corresponding to both end portions of recording sheet P in A-4 longitudinal feeding size in heat ray emitting area C to cool the heat ray fixing roller 17*a*. Further, when halogen lamp 171*g* having heat ray emitting area C is lit and printing for recording sheet P in A-3 longitudinal feeding size is conducted continuously, there is generated temperature rise on non-sheet conveyance portion shown with dotted lines to be convex even on a left end portion in FIG. 10 on temperature distribution shown with solid lines (c), and heat ray fixing roller 17*a* and pressure rubber roller 47*a* both on the temperature-risen portion are deteriorated. Therefore, fan F representing a cooling means is provided on the portion which is a left end portion of heat ray emitting area C and is a left end portion of the temperature distribution shown with solid lines (c) (also a left end portion of recording sheet P in A-3 longitudinal feeding size) to cool the heat ray fixing roller 17*a*.

Due to the foregoing, there is prevented deterioration of a heat ray fixing roller member and a pressure rubber roller both caused by temperature rise on non-sheet-conveyance sections which are different for each size of a transfer material, and there is prevented fixing offset for the large size caused by temperature rise on non-sheet-conveyance sections.

The temperature control stated above is conducted by temperature sensors TS11, TS12 and TS13 representing plural (more than two) temperature detection means provided to be in contact or non-contact with heat ray fixing roller 17*a* in its axial direction in the outer side of the heat ray fixing roller 17*a,* in accordance with both end portions of small-sized A-4 longitudinal feeding size width and with a left end portion of a large-sized A-3 longitudinal feeding size width, for the heat ray emitting area C. In addition, temperature sensors TS14 and TS15 both representing a temperature detection means are provided respectively at a central position of small-sized A-4 longitudinal feeding size area and at a position outside the A-4 longitudinal feeding size area and inside large-sized A-3 longitudinal feeding size area, to face heat ray fixing roller 17*a,* and control is made through an unillustrated control section so that image forming on large-sized recording sheet P in A-3 longitudinal feeding size including the temperature sensor TS15 is prohibited (when the temperature of the heat ray fixing roller 17*a* detected by the temperature detection means is the stipulated value or more, image forming on a large-sized transfer material size including the temperature detection means arrived at the stipulated value or more is prohibited) when the temperature detected by the temperature sensor TS15 exceeds an appropriate temperature value for fixing, for example, and arrives at a temperature that is higher than the stipulated temperature which causes high temperature offset. Further, image forming on a large-sized transfer material size including the temperature detection means arrived at the stipulated value or more is prohibited until the temperature of the heat ray fixing roller 17*a* is made uniform.

Due to the foregoing, fixing offset on a large size caused by temperature rise on the non-sheet-conveyance portion that differs depending on a size of a transfer material is prevented, and appropriate fixing in accordance with a size of a transfer material is conducted.

In FIG. 18, the invention also includes that sizes of transfer materials to be used are made to be 3 types or more by adding, for example, B-5 longitudinal feeding size and B-4 longitudinal feeding size (same width as that of B-5 lateral feeding size), and that temperature detection means including various sizes are provided, and when the temperature of a heat ray fixing roller member detected by the temperature detection means arrives at a stipulated value or more, image forming on large transfer material size including the temperature detection means arrived at the stipulated value or more is prohibited.

Further, as described in FIG. 3, there is provided heat equalizing roller TR4 that comes in contact with heat ray fixing roller 17*a* and pressure rubber roller 47*a* to attain heat equalizing in the longitudinal direction. However, if the heat equalizing roller TR4 is left to be in contact with them constantly, the speed of temperature rise is lowered. As shown in FIG. 19, therefore, the heat equalizing roller TR4 is provided so that it can be brought into contact with the heat ray fixing roller 17*a* and the pressure rubber roller 47*a* and the contact between them can be released, both by unillustrated lever and solenoid, to control heat equalizing of the heat ray fixing roller 17*a* in the lateral direction (direction perpendicular to the conveyance direction of a transfer material) by controlling the contact between the heat equalizing roller TR4 and the heat ray fixing roller 17*a* as well as the pressure rubber roller 47*a.* It is preferable that fans F serving as a cooling means are further provided on both end portions of the heat equalizing roller TR4 to lower temperatures on its both end portions.

As explained above, it is possible to uniformalize thermal conductivity by the following structures, even for recording sheets each having a different size.

A fixing unit for fixing a toner image formed on a transfer material on the transfer material by heating and pressurizing in which a roll-shaped heat ray fixing rotating member is formed by providing a cylindrical light transmissive base member that is transmissive for heat rays, a light transmissive elastic layer positioned outside the light transmissive base member, and a heat ray absorbing layer that is positioned outside the light transmissive elastic layer and absorbs the heat rays, and a pressure rubber roller is provided to face the heat ray fixing roller member, so that the transfer material is conveyed to a nip portion formed between the heat ray fixing roller member and the pressure rubber roller along one side of the heat ray fixing roller member that serves as a reference, wherein plural heat ray irradiating means which irradiate the heat rays are arranged in parallel inside the heat ray fixing roller member to control heating by the plural heat ray irradiating means in accordance with a size of the transfer material.

A fixing unit for fixing a toner image formed on a transfer material on the transfer material by heating and pressurizing in which a roll-shaped heat ray fixing rotating member is formed by providing a cylindrical light transmissive base member which has therein a heat ray irradiating means that irradiates heat rays and is transmissive for heat rays, a light transmissive elastic layer positioned outside the light transmissive base member, and a heat ray absorbing layer that is positioned outside the light transmissive elastic layer and absorbs the heat rays, and a pressure rubber roller is provided to face the heat ray fixing roller member, wherein a width of the transfer material that is conveyed along one side of the heat ray fixing roller member serving as a reference and is fixed by a nip portion formed between the heat ray fixing roller member and the pressure rubber roller, is set to be narrower than a width of the heat ray emitting area of the heat ray irradiating means, and cooling means which cool the heat ray fixing roller member are arranged on both ends corresponding in size to a size of the transfer material in the axial direction of the heat ray fixing roller member.

Two or more temperature detecting means are provided in the axial direction of the heat ray fixing roller member to control temperatures based on the temperature detected by the temperature detecting means.

When the temperature of the heat ray fixing roller member detected by the temperature detecting means is the stipulated value or more, image forming in a size of a transfer material including the temperature detecting means arriving at the stipulated value or more is prohibited.

The invention makes it possible to obtain the structure and conditions for a pressure rubber roller, under which a heat ray fixing roller member is rotated without damage of a light transmissive base member of the heat ray fixing roller member employing mainly a glass member, and fixing capability is improved.

In the Structures (1) and (2), in particular, damage of a light transmissive base member of the heat ray fixing roller member employing mainly a glass member is prevented, deformation of a rubber roller layer of the pressure rubber roller is less, and the pressure rubber roller functions as a drive roller without slipping, thus, accurate rotation of the heat ray fixing roller member is obtained.

In the Structure (3), an inversed crown is easily formed on the pressure rubber roller, and creases caused by fixing are prevented by the inversed crown formed on the pressure rubber roller.

In the Structure (4), pressure contact and releasing of the pressure contact for the pressure rubber roller can easily be conducted.

In the Structure (5), there is formed a nip portion wherein no slipping is caused and excellent fixing capability can be obtained.

In the Structures (6) and (7), there is formed a nip portion wherein excellent fixing capability can be obtained.

In the Structure (8), temperature rise of the heat ray fixing roller member is quickened, and parting characteristics in separation are improved for a transfer material that is fixed in a nip portion formed by both the heat ray fixing roller member and the pressure rubber roller.

In the structure (9), there is prevented lowing out of heat from the heat ray fixing roller member to the pressure rubber roller in the course of energizing, and speedup for temperature rise of the heat ray fixing roller member is achieved.

In the Structure (10), there are prevented deterioration of the heat ray fixing roller member and deterioration and deformation of the pressure rubber roller both caused by contact between the heat ray fixing roller member and the pressure rubber roller in the course of non-energizing. In particular, there is prevented exfoliation of a heat ray absorbing layer having remarkable temperature rise on a boundary surface from a light transmissive elastic layer.

What is claimed is:

1. A fixing apparatus for fixing a toner image on a transfer sheet with heat and pressure, comprising:

a heating roller comprising:

a cylindrical light transmitting base member, a heat ray generating device, provided inside of the cylindrical light transmitting base member, to generate a heat ray, a heat ray transmitting elastic layer provided on an outer surface of the cylindrical light transmitting base member and including a rubber layer, and a heat ray absorbing layer, provided on the outer surface of the cylindrical light transmitting base member, to absorb the heat ray passing through both of the cylindrical light transmitting base member and the heat ray transmitting elastic layer, and a pressing roller provided to come in contact with the heating roller so that the transfer sheet is nipped with a nip width between the heating roller and the pressing roller, said pressing roller including a rubber layer and being linked with a driving device so that the pressing roller rotates the heating roller through the contact therewith, wherein the heating roller and the pressing roller are shaped so as to satisfy the following formula:

$$\phi 1<\phi 2$$

where $\phi 1$ is an outer diameter of the heating roller and $\phi 2$ is an outer diameter of the pressing roller.

2. The fixing apparatus of claim 1, wherein the rubber layer of the pressing roller has a rubber hardness higher than that of the heating roller.

3. The fixing apparatus of claim 1, wherein a thickness of the heat ray transmitting elastic layer is not smaller than 0.5 mm.

4. The fixing apparatus of claim 1, wherein a thickness of the rubber layer of the pressing roller is larger than that of the heat ray transmitting elastic layer.

5. The fixing apparatus of claim 1, wherein a rubber hardness of the rubber layer of the pressing member is not larger than 80°.

6. The fixing apparatus of claim 1, wherein an outer diameter of the pressing roller is not larger than 60 mm and the nip width between the heating roller and the pressing roller is not larger than 15 mm.

7. The fixing apparatus of claim 1, wherein an outer diameter of the pressing roller is not larger than 60 mm and a thickness of the rubber layer of the pressing roller is not smaller than 2 mm.

8. The fixing apparatus of claim 1, wherein the heating roller and the pressing roller are shaped so as to satisfy the following formula:

$$0.5\leq\phi 1/\phi 2\leq 0.9$$

where $\phi 1$ is an outer diameter of the heating roller and $\phi 2$ is an outer diameter of the pressing roller.

9. The fixing apparatus of claim 1, wherein an outer diameter of the pressing roller at each of both ends is larger than that at a central portion between the both ends.

10. The fixing apparatus of claim 1, wherein when a temperature of the heating roller becomes higher than a predetermined temperature, the pressing roller starts rotating the heating roller.

11. The fixing apparatus of claim 1, wherein the pressing roller stops rotating the heating roller after the heat ray generating device stops generating the heat ray.

12. The fixing apparatus of claim 1, further comprising:

an actuator to bring one of the heating roller and the pressing roller in contact with the other one or to separate the heating roller and the pressing roller from each other.

13. The fixing apparatus of claim 12, wherein the actuator separates the heating roller and the pressing roller when the heat ray generating device starts generating the heat ray, and when a temperature of the heating roller becomes higher than a predetermined temperature, the actuator brings the one of the heating roller and the pressing roller in contact with the other one and the pressing roller starts rotating the heating roller.

14. The fixing apparatus of claim 12, wherein the actuator brings beforehand the one of the heating roller and the pressing roller in contact with the other one and when a temperature of the heating roller becomes higher than a predetermined temperature, the pressing roller starts rotating the heating roller.

15. The fixing apparatus of claim 12, wherein when a temperature of the heating roller becomes lower than a predetermined temperature, the pressing roller stops rotating the heating roller.

16. The fixing apparatus of claim 12, wherein when a temperature of the heating roller becomes lower than a predetermined temperature, the actuator separates the heating roller and the pressing roller so that the pressing roller stops rotating the heating roller.

17. The fixing apparatus of claim 12, wherein the pressing roller includes a gear engaged with a driving gear of the driving device, and when the actuator brings the pressing roller into contact with the heating roller or separates the pressing roller from the heating roller, the gear of the pressing roller moves around the driving gear of the driving device while keeping gear engagement with the driving gear.

18. A fixing apparatus for fixing a toner image on a transfer sheet with heat and pressure, comprising:

a heating roller comprising:

a cylindrical light transmitting base member, a heat ray generating device, provided inside of the cylindrical light transmitting base member, to generate heat ray, a heat ray transmitting elastic layer provided on an outer surface of the cylindrical light transmitting base member and including a rubber layer, and a heat ray absorbing layer, provided on the outer surface of the cylindrical light transmitting base member, to absorb the heat ray passing through both of the cylindrical light transmitting base member and the heat ray transmitting elastic layer, and a pressing roller provided to come in contact with the heating roller so that the transfer sheet is nipped with a nip width between the heating roller and the pressing roller, said pressing roller including a rubber layer and being linked with a driving device so that the pressing roller rotates the heating roller through the contact therewith, wherein when a temperature of the heating roller becomes higher than a predetermined temperature, the pressing roller starts rotating the heating roller.

19. A fixing apparatus for fixing a toner image on a transfer sheet with heat and pressure, comprising:

a heating roller comprising:

a cylindrical light transmitting base member, a heat ray generating device, provided inside of the cylindrical light transmitting base member, to generate heat ray, a heat ray transmitting elastic layer provided on an outer surface of the cylindrical light transmitting base member and including a rubber layer, and a heat ray absorbing layer, provided on the outer surface of the cylindrical light transmitting base member, to absorb the heat ray passing through both of the cylindrical light transmitting base member and the heat ray transmitting elastic layer, and a pressing roller provided to come in contact with the heating roller so that the transfer sheet is nipped with a nip width between the heating roller and the pressing roller, said pressing roller including a rubber layer and being linked with a driving device so that the pressing roller rotates the heating roller through the contact therewith, wherein the pressing roller stops rotating the heating roller after the heat ray generating device stops generating the heat ray.

20. A fixing apparatus for fixing a toner image on a transfer sheet with heat and pressure, comprising:

a heating roller comprising:

a cylindrical light transmitting base member, a heat ray generating device, provided inside of the cylindrical light transmitting base member, to generate heat ray, a heat ray transmitting elastic layer provided on an outer surface of the cylindrical light transmitting base member and including a rubber layer, and a heat ray absorbing layer, provided on the outer surface of the cylindrical light transmitting base member, to absorb the heat ray passing through both of the cylindrical light transmitting base member and the heat ray transmitting elastic layer, a pressing roller provided to come in contact with the heating roller so that the transfer sheet is nipped with a nip width between the heating roller and the pressing roller, said pressing roller including a rubber layer and being linked with a driving device so that the pressing roller rotates the heating roller through the contact therewith, and an actuator to bring one of the heating roller and the pressing roller in contact with the other one or to separate the heating roller and the pressing roller from each other, wherein when a temperature of the heating roller becomes lower than a predetermined temperature, the pressing roller stops rotating the heating roller.

21. The fixing apparatus of claim 20, wherein the actuator separates the heating roller and the pressing roller when the heat ray generating device starts generating the heat ray, and when a temperature of the heating roller becomes higher than a predetermined temperature, the actuator brings the one of the heating roller and the pressing roller in contact with the other one and the pressing roller starts rotating the heating roller.

22. The fixing apparatus of claim 20, wherein the actuator brings beforehand the one of the heating roller and the pressing roller in contact with the other one and when a temperature of the heating roller becomes higher than a predetermined temperature, the pressing roller starts rotating the heating roller.

23. The fixing apparatus of claim 20, wherein when a temperature of the heating roller becomes lower than a predetermined temperature, the actuator separates the heating roller and the pressing roller so that the pressing roller stops rotating the heating roller.

24. The fixing apparatus of claim 20, wherein the pressing roller includes a gear engaged with a driving gear of the driving device, and when the actuator brings the pressing roller into contact with the heating roller or separates the pressing roller from the heating roller, the gear of the pressing roller moves around the driving gear of the driving device while keeping gear engagement with the driving gear.

* * * * *